US008059989B2

(12) United States Patent
Tateishi et al.

(10) Patent No.: US 8,059,989 B2
(45) Date of Patent: Nov. 15, 2011

(54) COLOR ELECTROPHOTOGRAPHIC IMAGE FORMING APPARATUS WITH MEMBER SUPPORTING A PLURALITY OF CARTRIDGES

(75) Inventors: Tomoya Tateishi, Suntou-gun (JP); Takao Nada, Numazu (JP); Noritomo Yamaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/795,985

(22) Filed: Jun. 8, 2010

(65) Prior Publication Data

US 2010/0247143 A1 Sep. 30, 2010

Related U.S. Application Data

(62) Division of application No. 12/335,122, filed on Dec. 15, 2008, now Pat. No. 7,890,019.

(30) Foreign Application Priority Data

Nov. 7, 2008 (JP) ..... 2008-286388

(51) Int. Cl.
*G03G 21/16* (2006.01)

(52) U.S. Cl. ..... 399/111

(58) Field of Classification Search ..... 399/111, 399/299, 303, 110

See application file for complete search history.

(56) References Cited

U.S. PATENT DOCUMENTS

| | | | |
|---|---|---|---|
| 2006/0228131 | A1 | 10/2006 | Kimura et al. |
| 2008/0145122 | A1 | 6/2008 | Kaneko et al. |
| 2008/0159781 | A1 | 7/2008 | Noguchi et al. |

FOREIGN PATENT DOCUMENTS

| | | |
|---|---|---|
| JP | 07-261525 | 10/1995 |
| JP | 2005-249885 | 9/2005 |
| JP | 2008-152112 | 7/2008 |

*Primary Examiner* — David Gray
*Assistant Examiner* — Laura Roth
(74) *Attorney, Agent, or Firm* — Fitzpatrick, Cella, Harper & Scinto

(57) ABSTRACT

A color electrophotographic image forming apparatus is disclosed. The apparatus includes a cartridge supporting member supporting a plurality of cartridges and moving between a position inside a main body of the apparatus and a mounting and detaching position for mounting and detaching the cartridges. The apparatus further includes an engaging portion provided to one of the supporting member and the main body at a position corresponding to the mounting and detaching position for at least one cartridge, and a pressure member provided to the other and elastically urged to disengageably engage with the engaging portion. When the supporting member is moved from the inside position to the mounting and detaching position, a load required for movement of the supporting member at the mounting and detaching position is made larger than a load required for movement at other positions than the mounting and detaching position.

4 Claims, 21 Drawing Sheets

<INITIAL STATE>

<MOUNTING AND DETACHING POSITION FOR CARTRIDGE PY>

<MOUNTING AND DETACHING POSITION FOR CARTRIDGE PM>

<MOUNTING AND DETACHING POSITION FOR CARTRIDGE PC>

<MOUNTING AND DETACHING POSITION FOR CARTRIDGE PK>

COLOR ELECTROPHOTOGRAPHIC IMAGE FORMING APPARATUS WITH MEMBER SUPPORTING A PLURALITY OF CARTRIDGES

This is a divisional of U.S. patent application Ser. No. 12/335,122, filed Dec. 15, 2008, now U.S. Pat. No. 7,890,019.

BACKGROUND OF THE INVENTION

1. Field of the Invention

The present invention relates to a color electrophotographic image forming apparatus in which a plurality of cartridges are detachably mounted to an apparatus main body to form an image on a recording medium.

Here, a color electrophotographic image forming apparatus forms a color image on a recording medium using an electrophotographic image forming process, and examples of the color electrophotographic image forming apparatus include a color electrophotographic copying machine, a color electrophotographic printer (for example, a color laser beam printer and a color LED printer), color facsimile machine, and a color word processor.

The recording medium is one on which an image is formed by the electrophotographic image forming apparatus. Examples of the recording medium include paper and an OHP sheet.

The cartridge refers, for example, to a process cartridge or a developing cartridge. The cartridge is detachably mounted to the main body of the electrophotographic image forming apparatus to contribute to an image forming process to form an image on the recording medium. Here, the process cartridge is cartridge into which at least one of a charging means, a developing means, and a cleaning means serving as a process means and an electrophotographic photosensitive drum are integrally incorporated, the cartridge being detachably mountable to the main body of the electrophotographic image forming apparatus. Thus, the process cartridge may be a cartridge into which the developing means serving as the process means and the electrophotographic photosensitive drum are integrally incorporated, the cartridge being detachably mountable to the main body of the electrophotographic image forming apparatus. In addition, the process cartridge may be a cartridge into which the charging means and the developing means or the cleaning means serving as the process means, and the electrophotographic photosensitive drum are integrally incorporated, the cartridge being detachably mountable to the main body. The type of process cartridge which integrally includes an electrophotographic photosensitive drum and a developing means is referred to as a so-called integral type process cartridge. The type of process cartridge which integrally includes an electrophotographic photosensitive drum and a process means other than the developing means is referred to as a so-called separation type process cartridge.

Here, the process cartridge allows mounting to and detaching from the image forming apparatus main body by the user himself. Thus, the maintenance of the apparatus main body may be easily conducted. The process means acts on the electrophotographic photosensitive drum.

The developing cartridge refers to one which includes a developing roller, contains a developer (toner) used to develop an electrostatic latent image formed on the electrophotographic photosensitive drum by the developing roller, and is detachably mountable to the main body. In the case of the above-mentioned developing cartridge, the electrophotographic photosensitive drum is attached to the apparatus main body or a cartridge supporting member described below. Alternatively, the electrophotographic photosensitive drum is provided in the so-called separation type process cartridge (In this case, the process cartridge has no developing means). The developing cartridge also allows mounting to and detaching from the image forming apparatus main body by the user himself. Thus, the maintenance of the apparatus main body may be easily conducted.

The cartridge may be a so-called integral type or a so-called separation type process cartridge. Further, the cartridge may be formed as one in which a so-called separation type process cartridge and the developing cartridge are used as a pair. Further, the cartridge may be one in which the electrophotographic photosensitive drum is fixedly mounted to the apparatus main body or the cartridge supporting member described below and in which the developing cartridge is detachably used so as to be capable of acting on the electrophotographic photosensitive drum.

2. Description of the Related Art

As the mounting/detaching structure for the process cartridge, there is known one as disclosed in U.S. Patent Application Publication No. 2008/0159781. In this structure, the process cartridge is supported by the cartridge supporting member. Further, the cartridge supporting member slides between an inside position situated on the inner side of the apparatus main body and an outside position situated on the outer side of the apparatus main body. With the cartridge supporting member drawn out from the inside position to the outside position by the user, the process cartridge is mounted to and detached from the cartridge supporting member. Further, the user pushes in the cartridge supporting member to the inside position, whereby the process cartridge is mounted to an image forming position.

In the conventional art example described above, it is possible to achieve an improvement in terms of mounting/detaching operability of the process cartridge with respect to the apparatus main body.

SUMMARY OF THE INVENTION

It is an object of the present invention to further develop the conventional structure as described above.

Another object of the present invention is to provide a color electrophotographic image forming apparatus further improved in terms of mounting/detaching operability for the cartridge.

Still another object of the present invention is to provide a color electrophotographic image forming apparatus using a cartridge supporting member supporting a cartridge and moving between an inside position in an apparatus main body and a mounting and detaching position for the cartridge, in which a further improvement is achieved in terms of mounting/detaching operability for the cartridge with respect to the cartridge supporting member.

A further object of the present invention is to provide a color electrophotographic image forming apparatus in which when, at the time of movement of the cartridge supporting member from the inside position to the mounting and detaching position for the cartridge, at least one cartridge reaches the mounting and detaching position for the cartridge, a pressure member is engaged with an engaging portion, and in which, with this structure, the load required for moving the cartridge supporting member is made larger than the ordinary load, whereby the user may easily recognize a desired draw-out position. That is, the user may easily recognize that the cartridge supporting member has been drawn out to the position corresponding to the cartridge to be replaced. As a result, there is no need for the user to draw out the cartridge supporting member up to a needless position.

A further object of the present invention is to provide a color electrophotographic image forming apparatus in which when drawing out the cartridge supporting member supporting a plurality of cartridges, the user may easily recognize the required draw-out position for the cartridge supporting member.

A further object of the present invention is provide a color electrophotographic image forming apparatus in which when the cartridge to be replaced is discriminated, and the cartridge to be replaced reaches the mounting and detaching position for the cartridge, it is possible to increase the load required for drawing out the cartridge supporting member.

As a typical means for solving the above-mentioned problems, the present invention provides a color electrophotographic image forming apparatus having an apparatus main body to which a plurality of cartridges are detachably mounted to form an image on a recording medium, the color electrophotographic image forming apparatus comprising:

a cartridge supporting member, which moves between an inside position that is positioned inside the apparatus main body and a mounting and detaching position at which a cartridge are mountable and detachable, while supporting the plurality of cartridges;

an engaging portion, which is provided to one of the cartridge supporting member and the apparatus main body, and to a position corresponding to the mounting and detaching position of at least one cartridge among the plurality of cartridges supported by the cartridge supporting member; and a pressure member, which is provided to the other of the cartridge supporting member and the apparatus main body, and is elastically urged to disengageably engage with the engaging portion, wherein when the cartridge supporting member is moved from the inside position to the mounting and detaching position, the pressure member is engaged with the engaging portion so that a load required for movement of the cartridge supporting member at the mounting and detaching position is made larger than a load required for the movement of the cartridge supporting member at positions other than the mounting and detaching position.

According to the present invention, it is possible to achieve an improvement in terms of mounting/detaching operability for the cartridge.

According to the present invention, in a color electrophotographic image forming apparatus which uses a cartridge supporting member supporting cartridges and moving between an inside position of the apparatus main body and a mounting and detaching position for the cartridge, it is possible to further achieve an improvement in terms of cartridge mounting/detaching operability with respect to the cartridge supporting member.

According to the present invention, when the cartridge supporting member is moved from the inside position to the mounting and detaching position for the cartridge and when at least one cartridge reaches the mounting and detaching position, the pressure member is engaged with the engaging portion. This makes the load required for moving the cartridge supporting member larger than the ordinary load. As a result, the user may easily recognize a desired draw-out position. That is, according to the present invention, the user may easily recognize that the cartridge supporting member has been drawn out to the position corresponding to the cartridge to be replaced. As a result, there is no need for the user to draw out the cartridge supporting member up to a needless position.

According to the present invention, when drawing out the cartridge supporting member supporting a plurality of cartridges, the user may easily recognize the required draw-out position for the cartridge supporting member. According to another aspect of the present invention, when the cartridge to be replaced is discriminated, and the cartridge to be replaced reaches the mounting and detaching position for the cartridge, it is possible to increase the load required for drawing out the cartridge supporting member.

Further features of the present invention will become apparent from the following description of exemplary embodiments with reference to the accompanying drawings.

DESCRIPTION OF THE EMBODIMENTS

First Embodiment

General Structure of Color Electrophotographic Image Forming Apparatus

Figure 1:
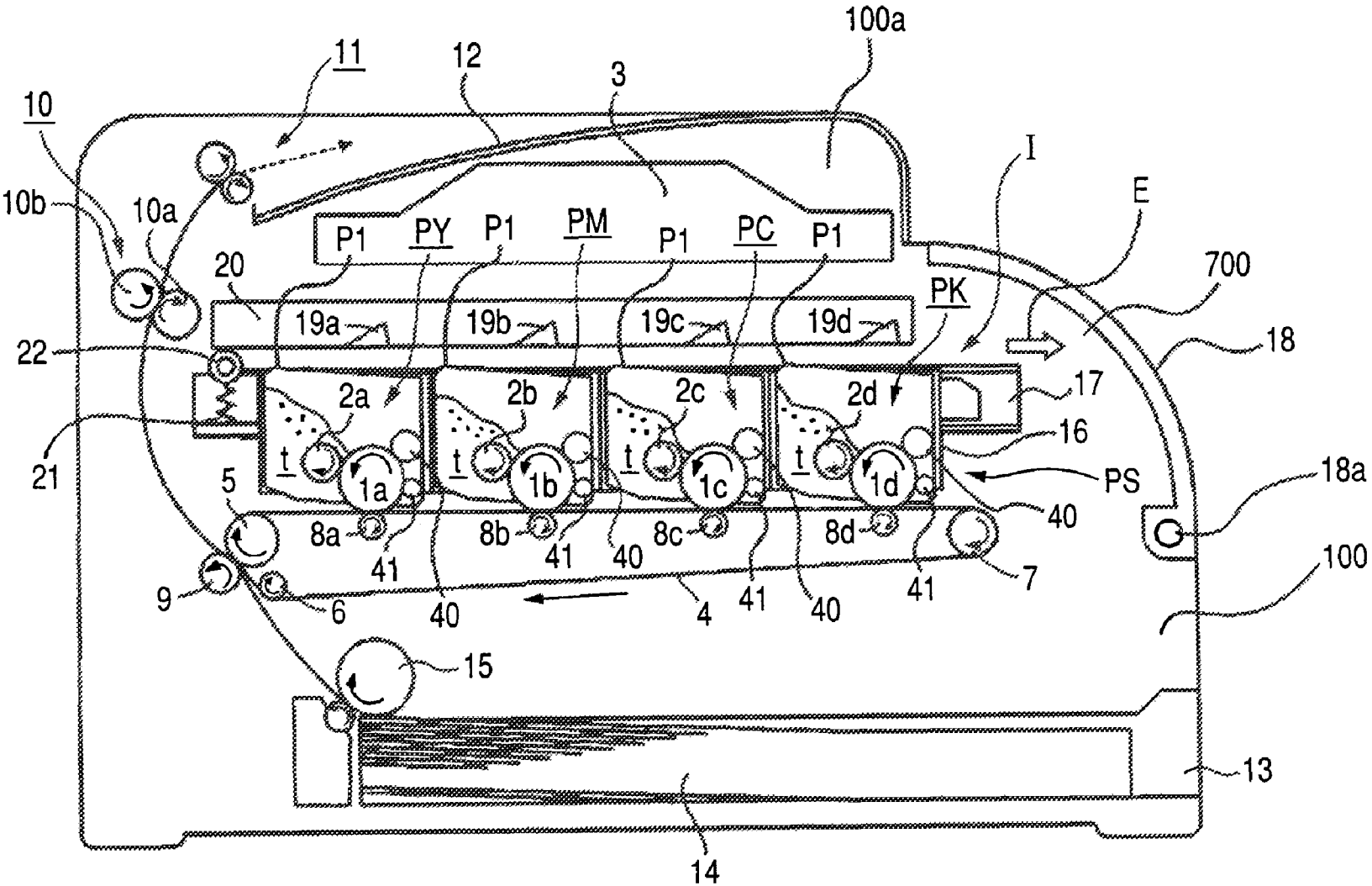
FIG. 1 is a sectional view illustrating a general structure of an image forming apparatus according to a first embodiment.
Figure 2:
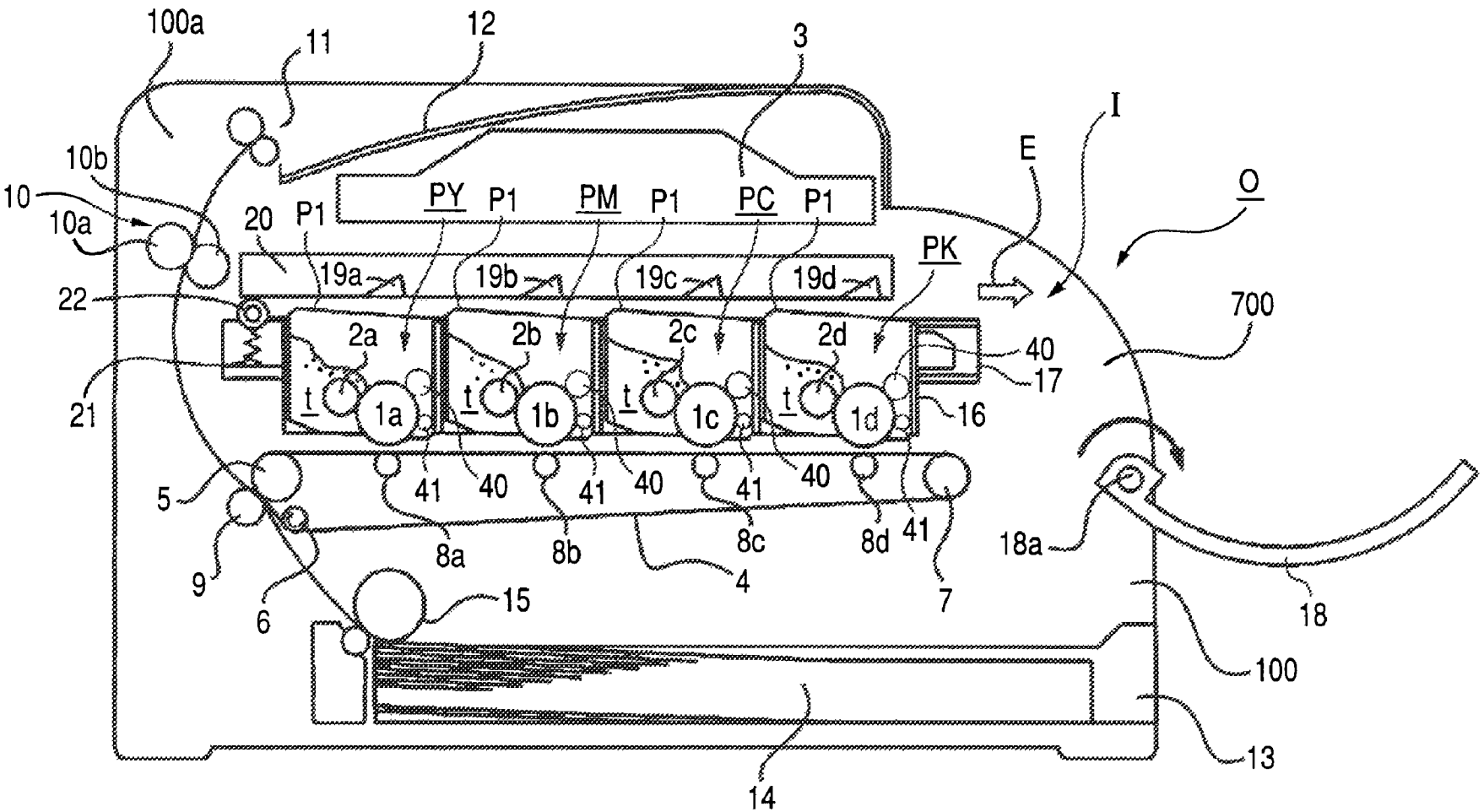
FIG. 2 is a sectional view illustrating how a cartridge tray according to the first embodiment is drawn out.

First, referring to FIGS. 1 and 2, a general structure of a color electrophotographic image forming apparatus according to a first embodiment (hereinafter referred to as image forming apparatus) will be described. FIG. 1 is an explanatory sectional view of the image forming apparatus, and FIG. 2 is an explanatory sectional view illustrating a process cartridge (hereinafter, referred to as cartridge) replacement in this embodiment.

An image forming apparatus 100*a* according to this embodiment is a four-color full-color laser printer using an electrophotographic process. Further, the image forming apparatus 100*a* forms an image on a recording medium (sheet) based on an image signal input from an external host apparatus 500 (FIG. 18) such as a personal computer, an image reader, or an associated facsimile apparatus.

In the following description, a front side of the image forming apparatus 100*a* is the side on which an apparatus opening/closing door (opening/closing member) 18 is arranged. A rear side (depth side) is the opposite side thereto. Further, right-hand and left-hand sides refer to the right-hand and left-hand sides of the apparatus main body as seen from the front side.

As illustrated in FIG. 1, inside the image forming apparatus main body (hereinafter, referred to as apparatus main body) 100, first through fourth cartridges P (PY, PM, PC, and PK) are horizontally arranged from the rear side to the front side. The cartridges P are of the same structure except for colors of developers "t" contained therein. The cartridge PY contains yellow developer "t". The cartridge PM contains magenta developer "t". The cartridge PC contains cyan developer "t". The cartridge PK contains black developer "t".

While the cartridges P are of the so-called integral type in this embodiment, this should not be construed restrictively. It is also possible to adopt cartridges of the structure as described above as the cartridges P.

Each of the cartridges P of this embodiment is formed by integrally assembling together an electrophotographic photosensitive drum (hereinafter, referred to as photosensitive drum) 1 (1*a*, 1*b*, 1*c*, 1*d*) and process means acting thereon within a cartridge frame P1 (FIG. 2). The process means of each of the cartridges P of this embodiment includes a developing means 2 (2*a*, 2*b*, 2*c*, 2*d*) for effecting development using an electrostatic latent image formed on the photosensitive drum 1. Further, the process means of the cartridges P includes a charging means 40 for uniformly charging the photosensitive drum 1, a cleaning means 41 for removing developer remaining on the photosensitive drum 1 after the transfer of a developer image onto a recording medium 14, etc. In this embodiment, a developing roller is used as the developing means 2, a charging roller is used as the charging means 40, and a cleaning blade is used as the cleaning means 41.

A laser scanner unit 3 is arranged above the cartridges P mounted to the apparatus main body 100. The scanner unit 3 scans and exposes a surface of the photosensitive drum 1 of each cartridge P with a laser beam. As a result, electrostatic latent images are successively formed on the photosensitive drums 1. Subsequently, the electrostatic latent images are developed by the developing means 2, whereby developer images are formed on the photosensitive drums 1.

Below the cartridges P mounted to the apparatus main body 100, an intermediate transfer belt 4 is arranged. The intermediate transfer belt 4 is passed around a driving roller 5, a driven roller 6, and a tension roller 7, and rotates in a direction indicated by the arrow in FIG. 1. The photosensitive drums 1 of the cartridges P have a lower surface held in contact with the upper surface of the transfer belt 4. (This position of the cartridge P is an image forming position PS described below.) In an inner side of the transfer belt 4, four primary transferring rollers 8 (8*a*, 8*b*, 8*c*, and 8*d*) are arranged while being opposed to the photosensitive drums 1 of the cartridges P.

A secondary transferring roller 9 is held in contact with the driving roller 5 through an intermediation of the transfer belt 4. In a rear upper portion of the apparatus main body 100, a fixing device 10 and a delivery roller pair 11 are arranged. A delivery tray 12 is disposed on the upper surface of the apparatus main body 100. There is used the fixing device 10 having a fixing film 10*a* and a pressure roller 10*b*.

In the image formation, the developer images formed on the photosensitive drums 1 are sequentially transferred to the transfer belt 4, and a color image is formed on the transfer belt 4. In synchronization with the image forming operation, a recording medium 14 contained and stacked in a sheet feed tray 13 disposed in the lower portion of the apparatus main body 100 is fed by the feeding roller 15 rotating in a direction indicated by the arrow in FIG. 1. The fed recording medium 14 is sent to a nip portion between the driving roller 5 and the secondary transferring roller 9.

Next, the developer images formed on the transfer belt 4 are transferred to the recording medium 14 sent to the nip portion between the driving roller 5 and the secondary transferring roller 9. Further, the recording medium 14 onto which the developer images are transferred is sent to a nip portion between the fixing film 10*a* and the pressure roller 10*b*, and heated and pressurized therein. As a result, the developer images are fixed to the recording medium 14. The recording medium 14 on which developer images are fixed is delivered onto the delivery tray 12 by the delivery roller pair 11.

In this embodiment, for the purpose of improvement in usability, a cartridge tray 16 (cartridge supporting member) is drawn out to the front side of the apparatus main body 100 while the cartridges P are supported by (accommodated in) the cartridge tray 16. With this structure, a user may replace the cartridges P from the front side (side in which door 18 is provided) of the apparatus main body 100 (so-called front access). The tray 16 is supported by a rail member 17 with respect to the apparatus main body 100. Further, the tray 16 is provided such that the user can slide the tray 16 in the front-rear direction by holding a grip portion 16*a*. The door 18 is provided rotatably about the shaft 18*a* with respect to the apparatus main body 100, FIG. 2 illustrates a state of opening the door 18.

When the user opens the door 18, the tray 16 moves upward by a predetermined amount by an interlocking mechanism (not shown) in association with the opening operation. In accordance therewith, the cartridges P (PY, PM, PC, and PK) supported by the tray 16 move upward by a predetermined amount. As a result, a coupling between a drive input portion (not shown) provided on each of the cartridges P and a drive output portion (not shown) provided on the apparatus main body 100 is released. Further, the positioning of each of the cartridges P with respect to the apparatus main body 100 is released. Still further, the photosensitive drums 1 are separated from the transfer belt 4 (FIG. 2). As a result, the user can draw the tray 16 out of the image forming apparatus 100.

Note that, in association with the closing operation of the door 18 performed by the user, the drive input portion (not shown) and the drive output portion (not shown) are coupled to each other with the interlocking mechanism (not shown). Further, the positioning of the cartridges P with respect to the apparatus main body 100 is conducted. As a result, the photosensitive drums 1 are brought into contact with the transfer belt 4 (FIG. 1). This contact state shows an image formation operable position, that is, the position where the cartridge P performs an image forming operation.

In this case, the apparatus main body 100 is the image forming apparatus 100*a* excluding the cartridges P and the tray 16 therefrom.

<Mounting and Detaching Structure of Cartridges>

In the following, the drawing and the accommodation of the tray 16 in this embodiment will be described.

Figure 3:
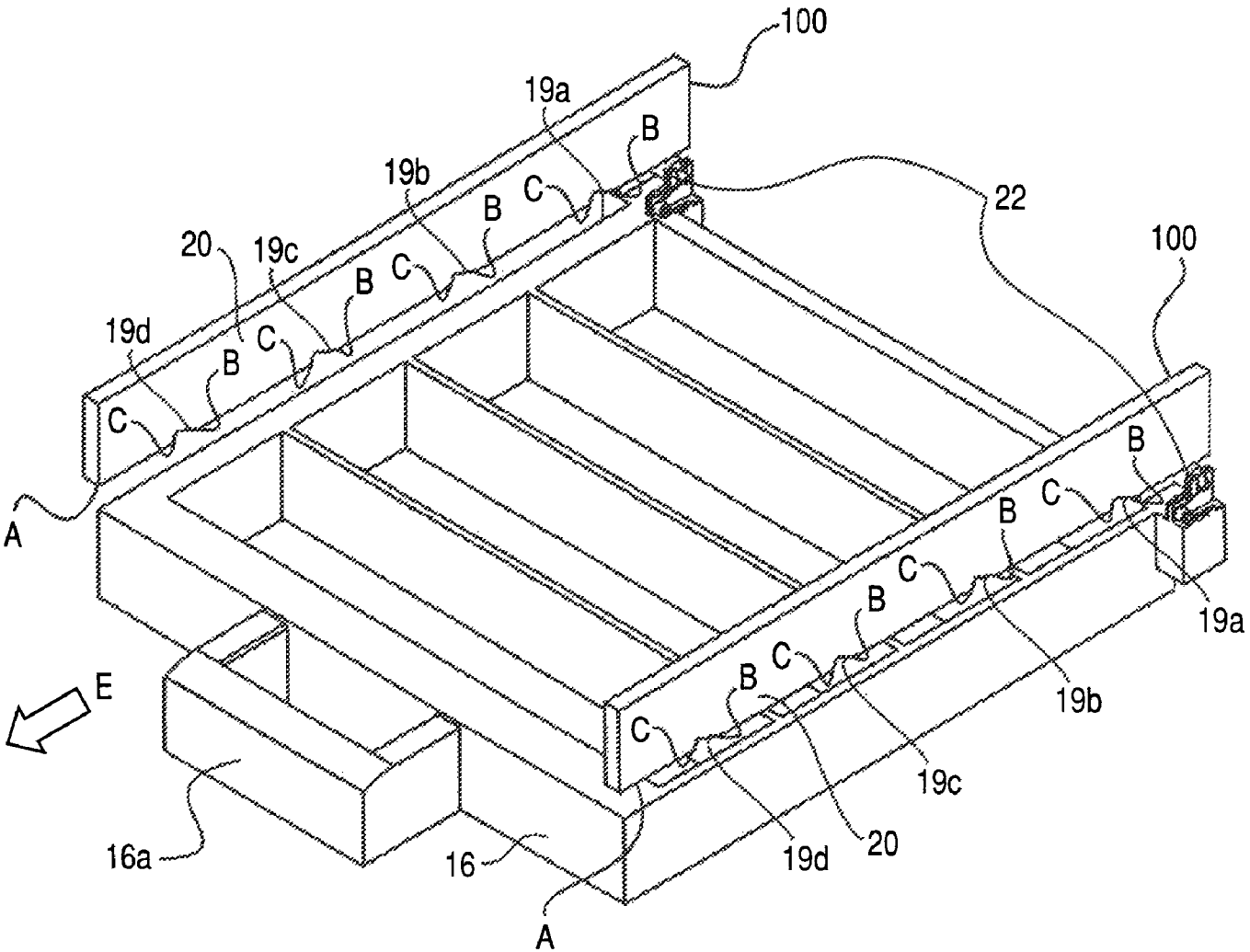
FIG. 3 is a perspective view of an arrangement of the cartridge tray and an abutment member according to the first embodiment.

FIG. 3 illustrates a state where the tray 16 is positioned in an inside position I of the apparatus main body 100, and illustrates a relationship among the tray 16, abutment members 20 provided in the apparatus main body 100, and rotary members 22.

As illustrated in FIG. 3, in a state in which the tray 16 is mounted to the apparatus main body 100, the abutment members 20 are provided above opposite to the lateral sides of the tray 16 positioned in the apparatus main body 100. Each of the abutment members 20 is provided with four groove portions (engaging portions) 19 (19*a*, 19*b*, 19*c*, and 19*d*).

Figure 4:
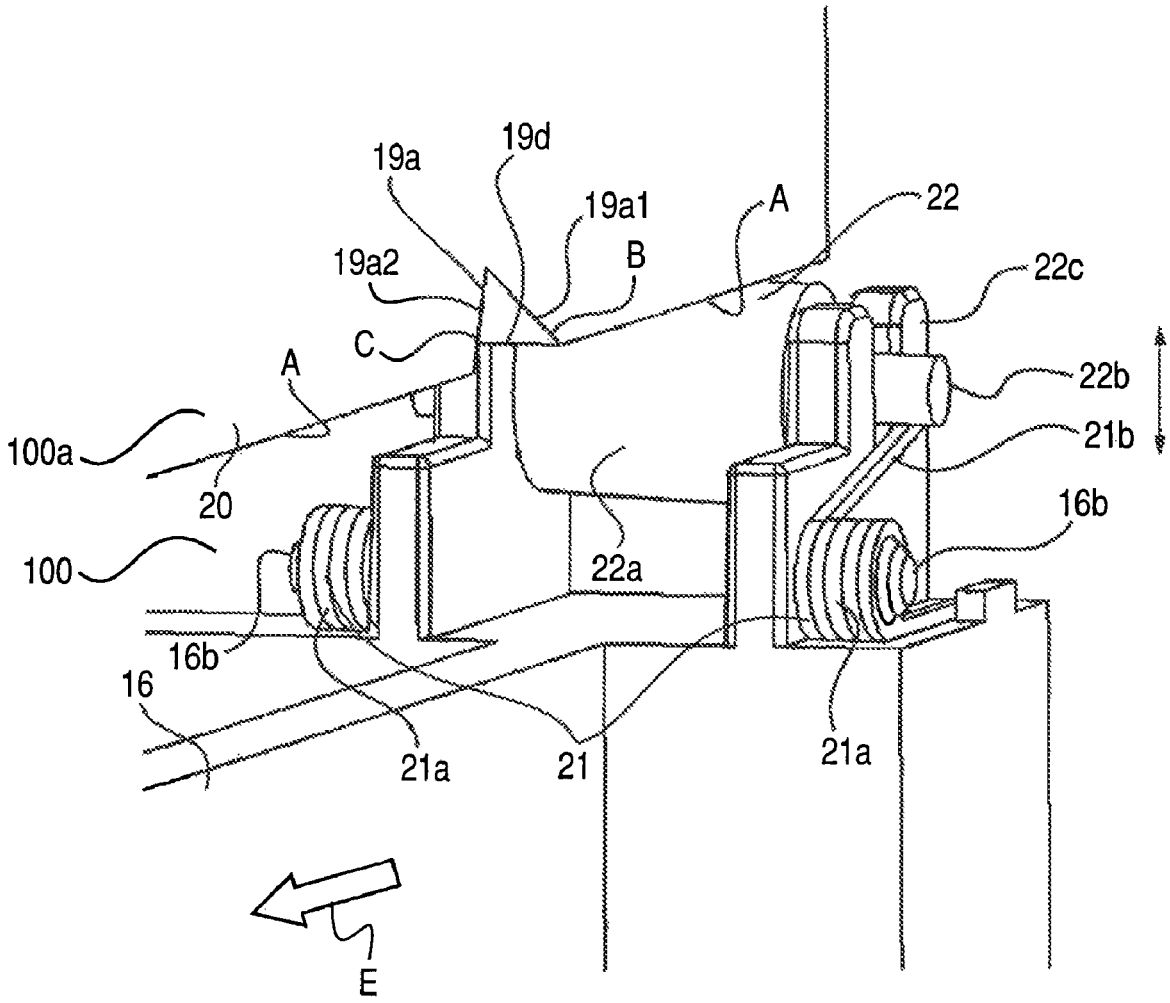
FIG. 4 is a perspective view illustrating an arrangement of an urging member, a rotary member, and the abutment member according to the first embodiment.

Further, as illustrated in FIG. 3, in both rear right and left sides of the tray 16, the rotary members 22 serving as pressure members are provided at positions capable of being engaged with the groove portions 19, while being pressed against the lower surfaces of the abutment members 20. As illustrated in FIG. 4, a rotation shaft 22*b* of a roller 22*a* of the rotary member 22 is fitted into a U-shaped groove 22*c* so that the rotary member 22 is movable up and down in a predetermined range. The rotation shaft 22*b* is urged upward by an elastic force of a coil spring 21 (elastic member). As a result, the roller 22*a* is brought into pressure contact with a lower surface A of the abutment member 20. Note that a stopper (not shown) is provided above the U-shaped groove 22*c*. As a result, before the roller 22*a* urges the lower surface A upward, the stopper (not shown) regulates an upward movement of the rotation shaft 22*b*.

Note that the spring 21 has one end 21*a* fixed to a shaft 16*b* provided to the tray 16, and the other end 21*b* urging the shaft 22*b* upward. Note that the elastic member is not limited to the coil spring 21. For example, a plate spring may be applicable.

Note that the lower surface A is formed horizontally with respect to the front-rear direction. In addition, a pressing force of the spring 21 (elastic member) is applied substantially perpendicular to the front-rear direction. Further, the diameter of the roller 22*a* is smaller than an opening of each of the groove portions 19. When the tray 16 is drawn forward, the rotary member 22 rotates along the lower surface A of the abutment member 20. When each of the groove portions (engaging portion) 19 reaches the position of the rotary member 22, the rotary member 22 enters the groove portion 19 so as to engage with the groove portion 19. As a result, the load required for the user for the movement of the tray 16 was made larger than the load of a case in which the groove portion (engaging portion) 19 and the rotary member 22 (pressure member) are not engaged with each other. Note that the rotary member 22 is rotatable about the shaft 22*b*. Accordingly, when the tray 16 moves, the rotary member 22 rotates and slides along the lower surface A. As a result, it is possible to reduce the load applied from the rotary member 22 in the movement of the tray 16.

Note that, in this embodiment, the abutment members 20 are provided on both the lateral side surfaces on the inside of the apparatus main body 100. However, the abutment member 20 may be provided to only one of the lateral sides, and the rotary member 22 may be provided at any position of the tray 16 as long as being engageable with groove portions 19. However, the rotary member 22 is arranged in an upstream side of the groove portion 19 in the drawing direction E (FIGS. 3 and 4) of the tray 16.

In this embodiment, the groove portions (engaging portions) 19 are provided in accordance with the tray 16 and in accordance with supporting positions of the cartridges P supported by (mounted to) the tray 16. Accordingly, every time each of the cartridges P reaches a mounting and detaching position for the cartridge when the user moves the tray 16 from the inside position to the mounting and detaching positions of the cartridges, the rotary member 22 is elastically engaged with the corresponding groove portion 19. Accordingly, every time each of the cartridges P reaches the mounting and detaching position for the cartridge when the user draws out the tray 16 toward the user, the load required for the movement of the tray 16 becomes larger than the load of a case in which the groove portion 19 and the rotary member 22 are not engaged with each other. Accordingly, the user may obtain a clicking feeling every time when each of the cartridges P reaches the mounting and detaching position for the cartridge. As a result, the user may easily recognize that the drawing operation of the tray 16 is stopped in the state in which the desired cartridge P reaches the mounting and detaching position for the cartridge.

Note that the lateral sides on the inside of the apparatus main body 100 refer to one end side and the other end side in a direction orthogonal to the drawing direction E (FIG. 3) of the tray 16.

Further, the front-rear direction refers to the drawing direction E of the tray 16. As described above, in this embodiment, the groove portion (engaging portion) 19 and the rotary member 22 are elastically engaged with each other. Accordingly, the engagement between the groove portion (engaging portion) 19 and the rotary member 22 may be more reliably performed. Further, the rotary member 22 may be smoothly separated from the groove portion (engaging portion) 19 with the aid of the deflection of the spring 21.

In addition, in this embodiment, the groove portion 19 is a recessed portion in the shaped of a triangular prism. That is, in the drawing direction E of the tray 16, the groove portion has an inclined surface B gradually inclined from the upstream side to the downstream side, and a declined surface C gradually declined from the upstream side to the downstream side. With this structure, the rotary member 22 may smoothly enter the groove portion (engaging portion) 19. Further, the rotary member 22 may be smoothly separated from the groove portion (engagement position) 19.

With reference to FIGS. 5A, 5B, 5C, and 5D, this structure will be described in more detail.

FIGS. 5A to 5D illustrate a process in which the rotary member 22 is engaged with the groove portion 19 in association with the drawing operation. Each of the groove portions 19 includes a first surface B with which the rotary member 22 is brought into contact in the entering process, and a second surface C with which the rotary member 22 is brought into contact in the exiting process. An angle θ1 formed by the first surface B with the lower surface A is set smaller than an angle θ2 formed by the second surface C with the lower surface A. Accordingly, when the tray 16 is drawn out of the apparatus main body 100 to the mounting and detaching positions, the clicking feeling is imparted every time the rotary member 22 is engaged with the groove portion 19. However, when the tray 16 is forced into the apparatus main body 100 from the mounting and detaching positions, the clicking feeling is imparted not in the same degree as in the case of drawing the tray 16 from the apparatus main body 100 when the rotary member 22 is engaged with the groove portion 19. As a result, the tray 16 may be smoothly forced into the apparatus main body 100.

Figure 5A:
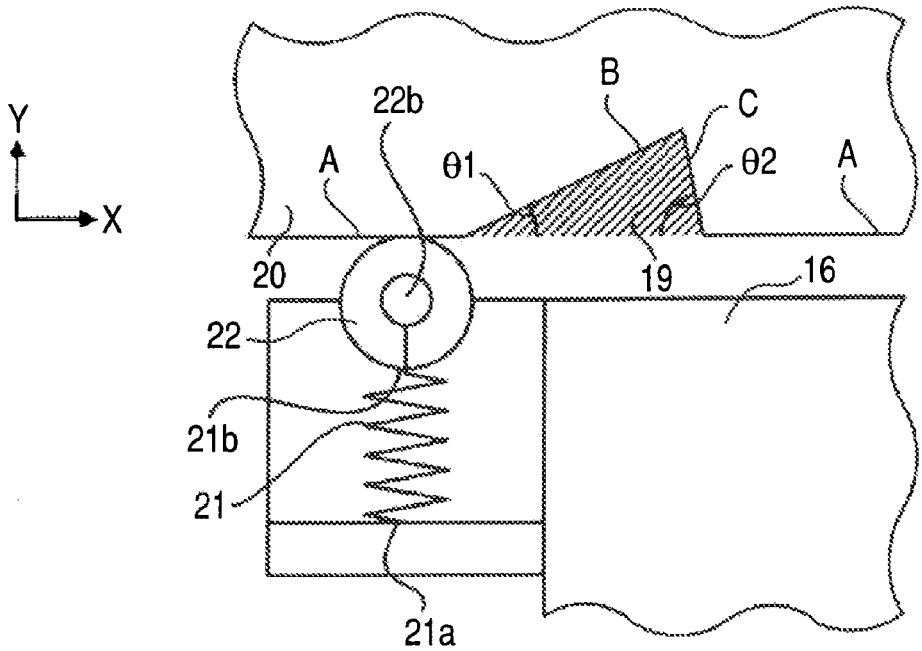
FIGS. 5A, 5B, 5C, and 5D are diagrams illustrating an engagement process for the rotary member and a groove portion according to the first embodiment.

In the above-mentioned structure, first, in FIG. 5A illustrating a state before the engagement, the rotary member 22 is moved in the forth direction (positive direction of X-axis in FIG. 5A) while being rotating and pressed onto the lower surface A. In this case, the positive direction of X-axis refers to the drawing direction E of the tray 16.

Figure 5B:
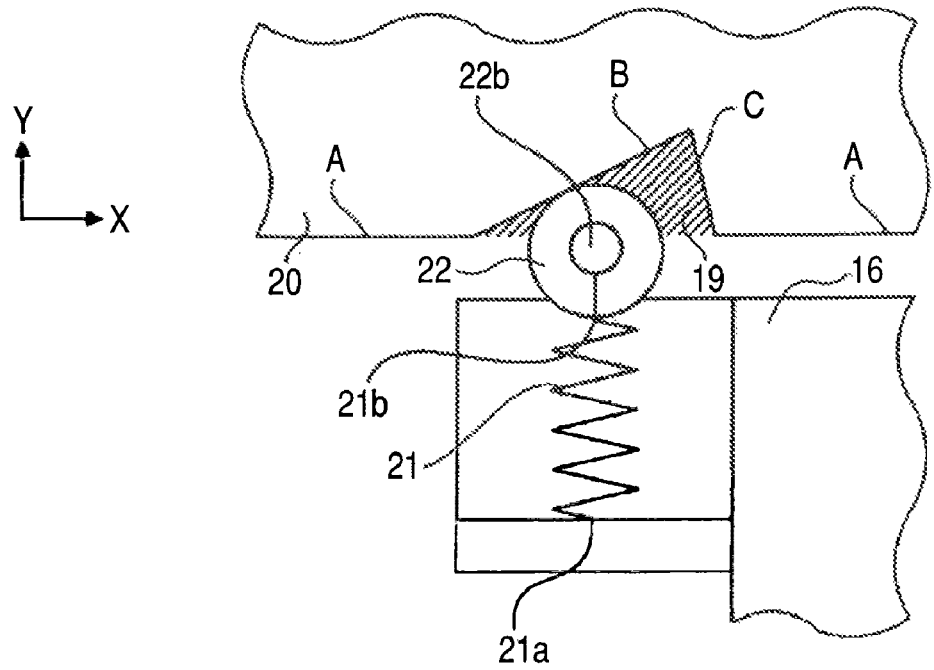
Figure 5C:
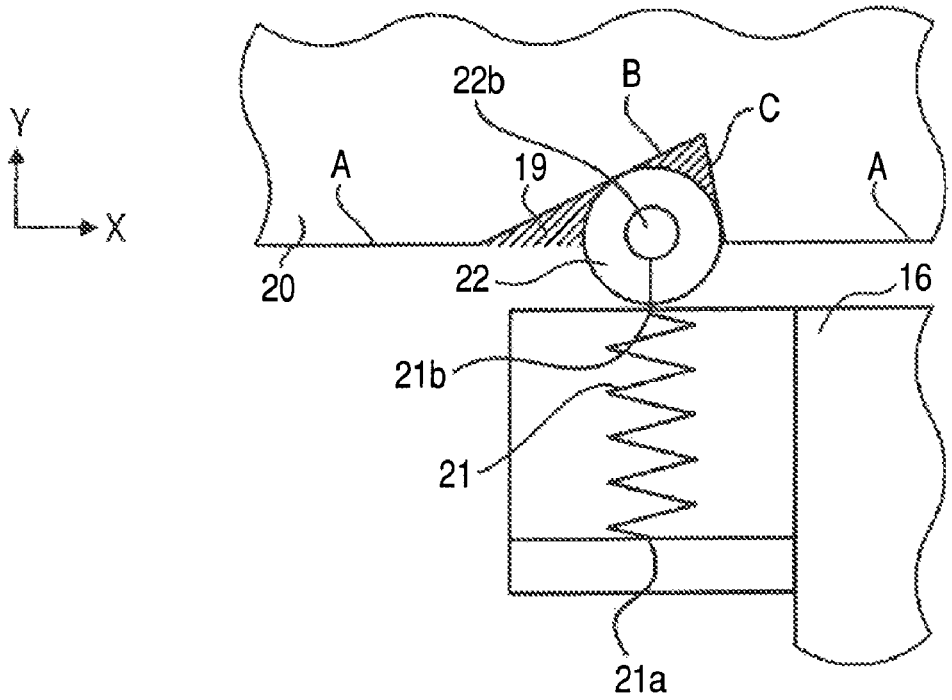

Next, in FIG. 5B illustrating the process of entering the groove portion 19, the rotary member 22 is urged by the first surface B, thereby being drawn in the drawing direction by receiving a forward force. Next, when the rotary member 22 is brought into contact with the second surface C and enters a state illustrated in FIG. 5C, the rotary member 22 receives resistance from the surface C in the back direction (downstream side in drawing direction E). Then, the rotary member 22 is loosely engaged at this position. The position of the tray 16 at this time is the mounting and detaching position for the cartridge. That is, the user obtains the clicking feeling at this position. Accordingly, the user may easily recognize that the drawing operation of the tray 16 is stopped at this position.

In this embodiment, at the time of moving the tray 16 from the inside position to the mounting and detaching position for the cartridge, the rotary member 22 is engaged with the groove portion 19. As a result, the load required for the movement of the tray 16 is larger than a load of a case in which the groove portion 19 and the rotary member 22 are not engaged with each other.

Figure 5D:
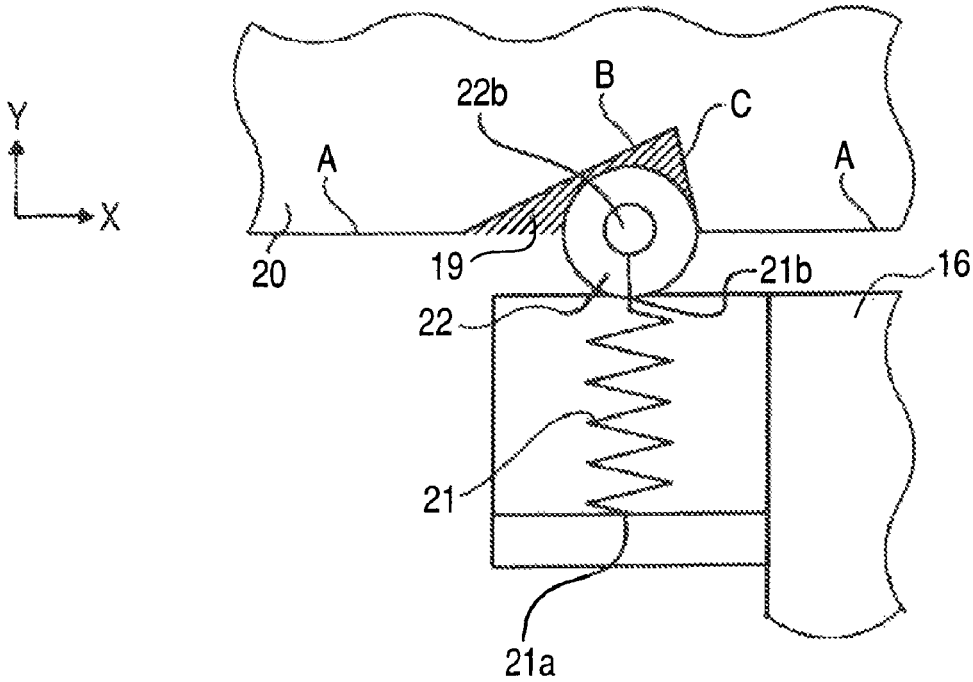

FIG. 5D illustrates a process in which the rotary member 22 exits (is separated from) one of the groove portions 19. The rotary member 22 passes the second surface C by being drawn out by a force larger than the above-mentioned resistance, and comes into contact with the lower surface A again, thereby making it possible to be further drawn out.

Figure 6A:
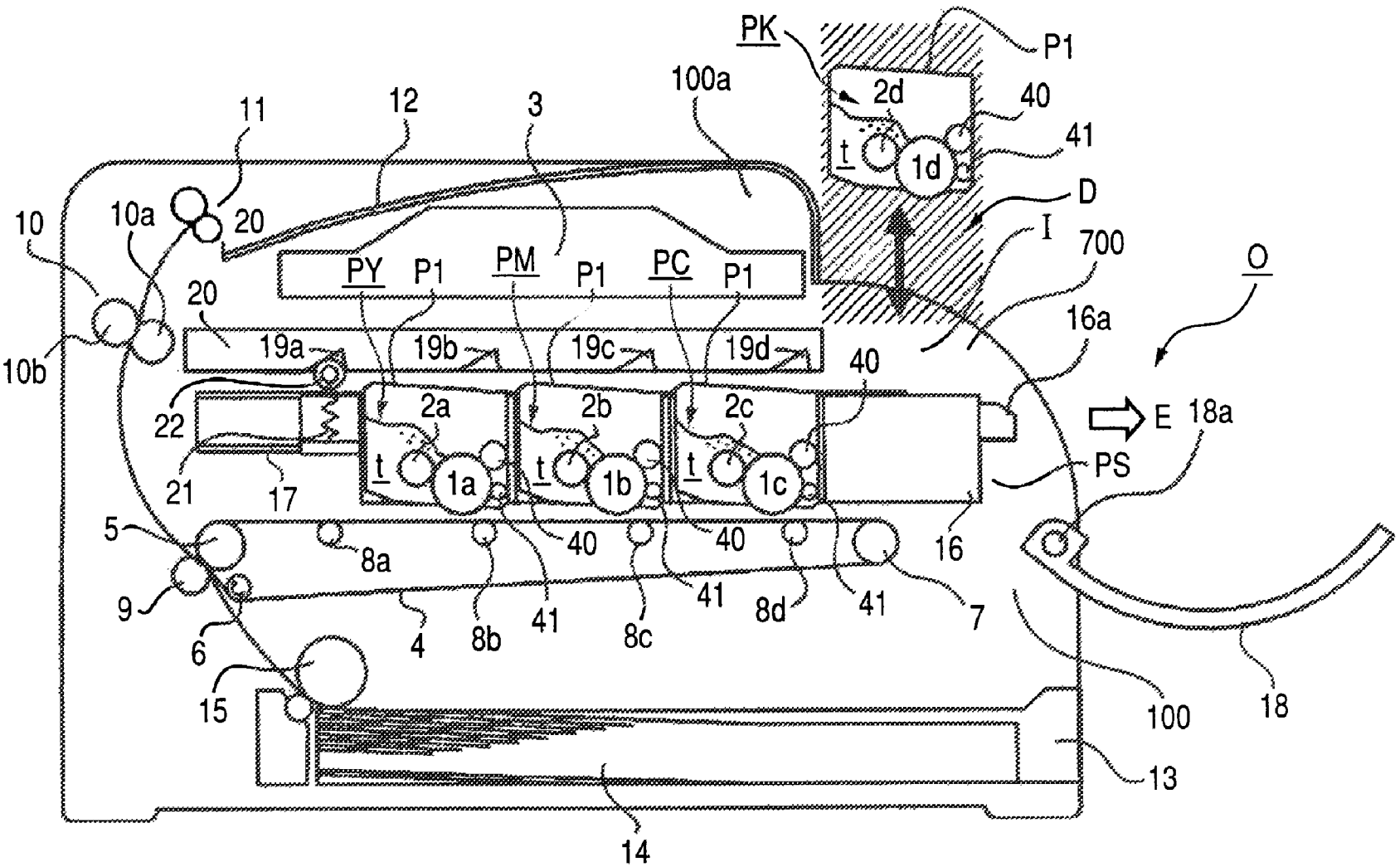
FIG. 6A is a sectional view illustrating how cartridge replacement is effected in the first embodiment.

FIG. 6A illustrates a mounting and detaching position of the cartridge PK containing the black developer "t" in a case in which the rotary member 22 is engaged with the groove portion 19*a*. In this case, the cartridge PK is mountable and detachable in an upper surface opening region D. Then, when the tray 16 is further drawn out, the rotary member 22 is sequentially engaged with the groove portions 19*b*, 19*c*, and 19*d*, and in the process illustrated in FIGS. 5A to 5D, the rotary member 22 is engaged therewith in the same manner at the respective mounting and detaching positions for the cartridges. In other words, when the rotary member 22 is engaged with the groove portions 19*b*, 19*c*, and 19*d*, the cartridges PC, PM, and PY reach the upper surface opening region D, respectively. At those positions, the user obtains a clicking feeling at the operation of drawing out. Those positions correspond to the mounting and detaching positions for the cartridges P.

Note that, the upper surface opening region D (opening 700) is a region formed by opening the door 18.

Note that, the door 18 rotates about the shaft 18*a*. The door 18 can open and close the opening 700 provided in the apparatus main body 100. The tray 16 passes the opening 700 and moves between the outside position O and the inside position I.

Figure 6B:
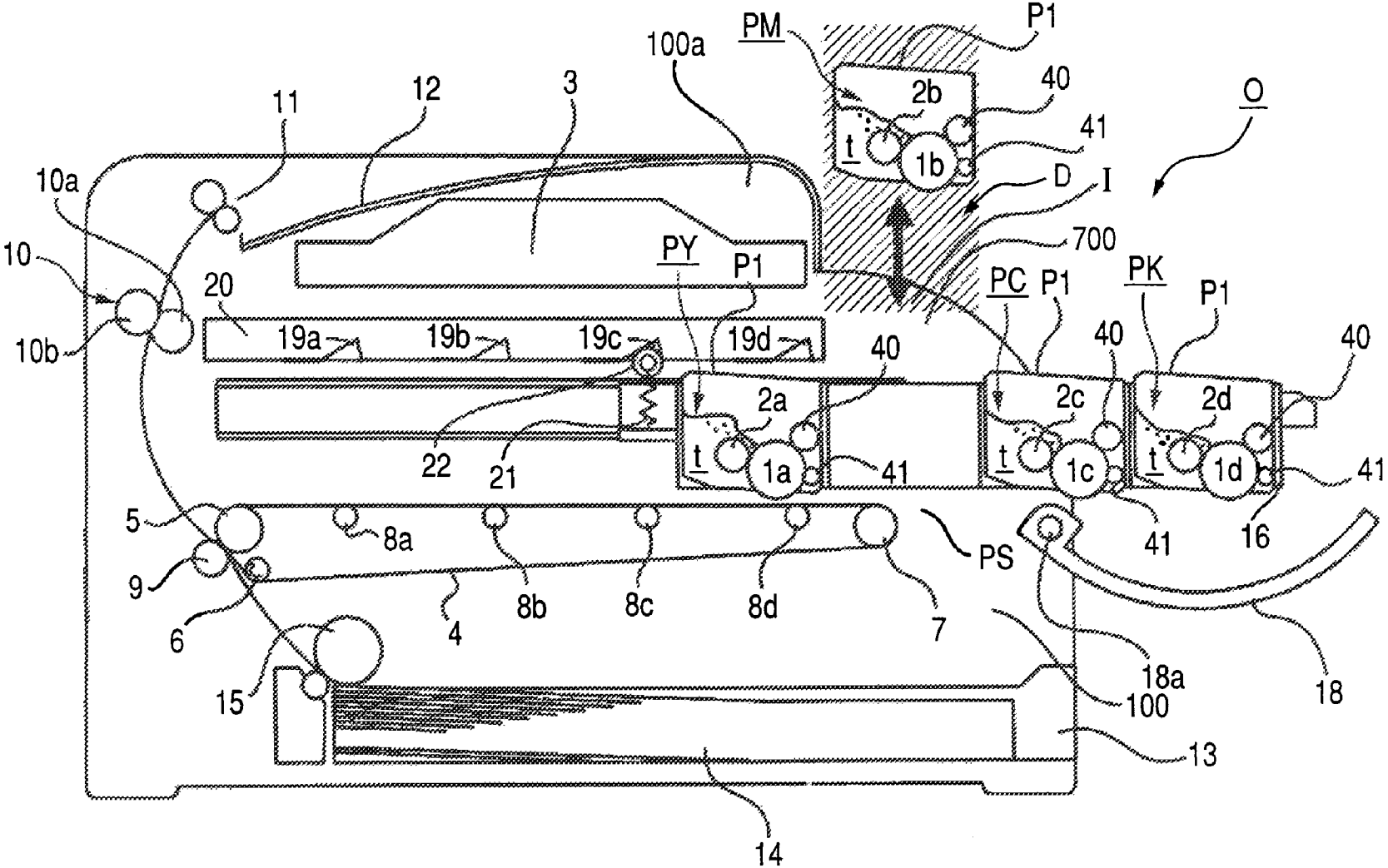
FIG. 6B is a sectional view of the cartridge replacement state of the first embodiment, illustrating the cartridge tray as drawn out to an exterior from an apparatus main body.

FIG. 6B illustrates a state in which the tray 16 is drawn out of the apparatus main body 100 and is in the outside position O. FIG. 6B illustrates a mounting and detaching position of the cartridge PM containing the magenta developer "t" in the case in which the rotary member 22 is engaged with the groove portion 19*c*.

Accordingly, when any one of the cartridges P is replaced, the user can recognize by the clicking feeling that the desired cartridge P reaches the mounting and detaching position for the cartridge. In this embodiment, the mounting and detaching position for the cartridge corresponds to the region D. The user can perform mounting and detaching of the cartridge P through the region D. Thus, the tray 16 is prevented from being drawn out more than necessary, thereby improving an operability of mounting and detaching of the cartridge.

Further, as described above, when the rotary member 22 is engaged with and disengaged from the groove portions 19, the user obtains the clicking feeling. Therefore, when detaching any one of the cartridges, the user may easily recognize the stop position of the tray 16.

Further, when the tray 16 is to be accommodated in the apparatus main body 100, the tray 16 is moved and slid in an opposite direction, i.e., from the front side to the depth side of the apparatus main body 100. In this case, while the rotary member 22 is engaged with the groove portions 19 by a procedure opposite to the above-mentioned process, the angle θ1 is set smaller than the angle θ2. Thus, the resistance when the rotary member 22 exits the groove portions 19 is smaller than that when the tray 16 is drawn out of the apparatus main body 100. Therefore, the tray 16 can be smoothly accommodated in the apparatus main body 100.

Note that, in this embodiment, the rotary member 22 is provided on the tray 16, and the groove portions 19 are provided on the apparatus main body side. However, the rotary member 22 may be provided on the apparatus main body side, and the groove portions 19 may be provided on the tray 16 side. In other words, the rotary member 22 serving as the pressure member may be provided on one of the tray 16 and the apparatus main body 100, and the groove portion (engaging portion) 19, with which the rotary member 22 may be engaged, may be provided on the other of the tray 16 and the apparatus main body 100.

Further, according to this embodiment, the same number of groove portions 19 as the cartridges are provided at four corresponding mounting and detaching positions of the cartridges. However, the present invention is not limited thereto. For example, the same number or more groove portions than the cartridges may be provided, or the less number of groove portions than the cartridges may be provided.

In addition, in this embodiment, the same number of groove portions 19 as the cartridges P are provided and one rotary member 22 is sequentially engaged with the respective groove portions 19. However, one groove portion 19 is provided, and the same number or more rotary members 22 as the cartridges may be provided. Further, in accordance with the movement of the tray 16, one groove portion 19 may be engaged with the rotary member 22 provided at the corresponding mounting and detaching positions of the cartridges.

As described above, the tray (cartridge supporting member) 16 supports the cartridges P, and moves between the inside position I of being inside the apparatus main body 100 and the outside position O of being outside the apparatus main body 100.

Note that, the outside position O is a position in which the user mounts and detaches the cartridges P with respect to the tray 16.

Note that, the cartridges P which are supported by (mounted to) the tray 16 at the outside position O moves to the inside position I when the user pushes the tray 16 into the apparatus main body 100. The cartridge P is in the image forming position PS for contributing the image formation (see FIGS. 1, 7, 9, 10, and 13). Note that, according to this embodiment, the image forming position PS corresponds to a state in which a part of the photosensitive drums 1 comes into contact with the transfer belt 4. According to this embodiment, when the door 18 is closed in the state in which the tray 16 is in the inside position I, the tray 16 descends and the cartridges P are in the image forming position PS. Further, when the door 18 is opened, the cartridges P ascend as the tray 16 ascends. Thus, the photosensitive drums 1 are separated from the transfer belt 4 (see FIGS. 2, 6A, 6B, 8, 11, 12A, and 12B). In this state, the user draws out the tray 16 toward the outside position O of the apparatus main body 100 (in the direction indicated by the arrow E). Note that, according to this embodiment, when the cartridge PK positioned on the most downstream side in the drawing direction E is mounted to and detached from the tray 16, the tray 16 may not be in the outside position O (see FIGS. 6A, 8, and 12A). Even in this case, the tray 16 is drawn more in the outer side direction when compared to the case in which the cartridges P are in the image forming position PS. Therefore, the cartridge P is drawn more on the front side of the apparatus main body 100 when compared to the case in which the cartridge P is in the image forming position PS, and hence the user may easily replace the cartridge P.

Second Embodiment

Figure 7:
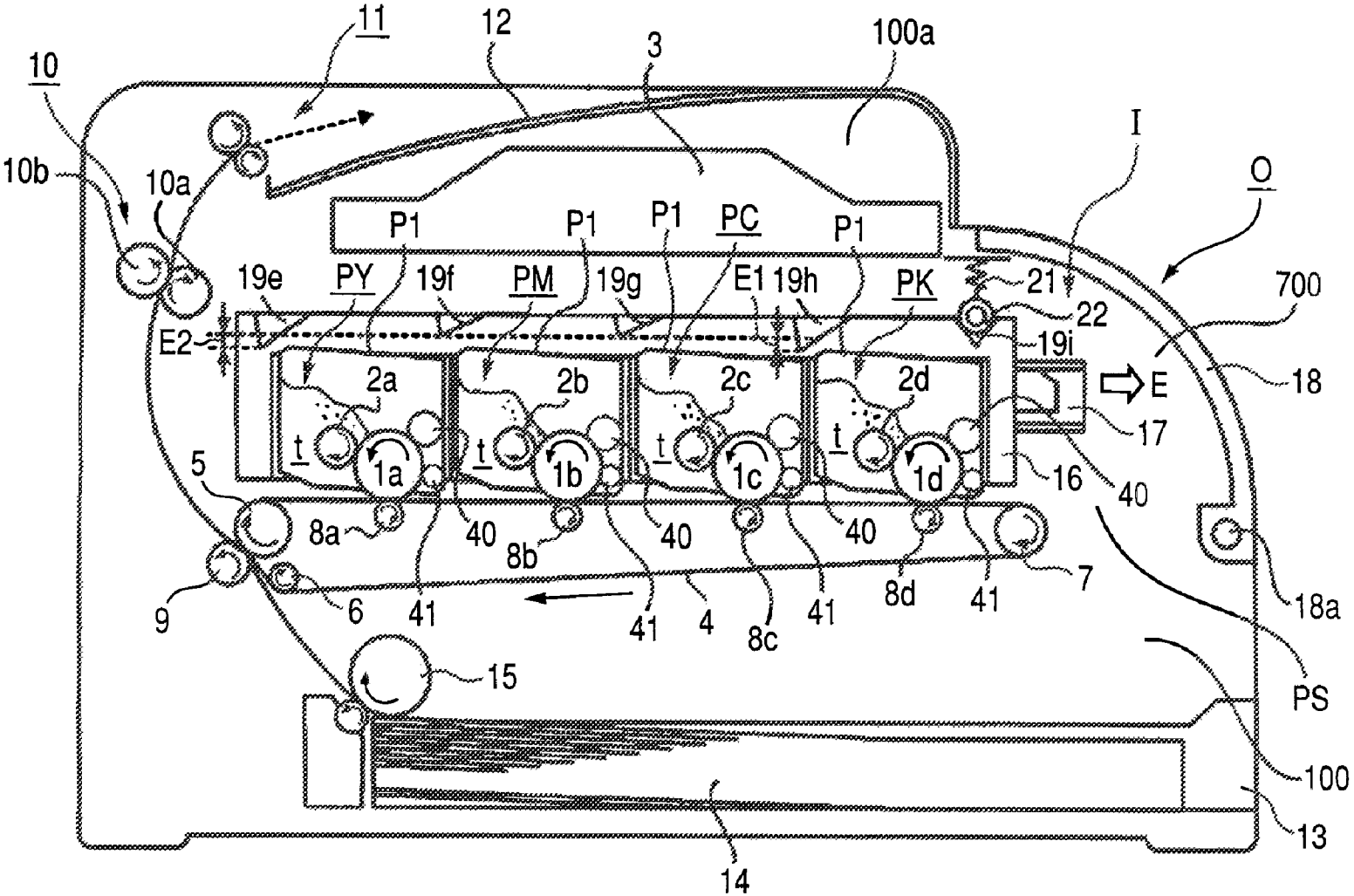
FIG. 7 is a sectional view of a general structure of an image forming apparatus according to a second embodiment.

Next, an image forming apparatus according to a second embodiment of the present invention will be described with reference to FIGS. 7 and 8. FIG. 7 illustrates structure of the image forming apparatus according to this embodiment. In the following, a description will be provided with reference to FIG. 7. However, a procedure for the image formation is similar to that of the first embodiment, and components having the same structure and operation are denoted by the same reference symbols and the descriptions thereof are omitted.

In the first embodiment, the rotary member 22 is provided on the tray 16 side, and the groove portions 19 are provided on the apparatus main body 100 side. In this embodiment, five groove portions 19 (19*e*, 19*f*, 19*g*, 19*h*, and 19*i*) are provided in the upper portion of the side surface of the tray 16. Further, on the inner side surface of the apparatus main body 100, there is provided the rotary member 22 which is urged to the groove portions 19 side by the elastic force of the elastic member 21 with respect to the upper surface of the tray 16.

The upper surface of the tray 16 is substantially horizontal with respect to the front-rear direction. The pressing force (elastic force) of the elastic member 21 is substantially vertical with respect to the front-rear direction.

The groove portions 19 (19*h*, 19*g*, 19*f*, and 19*e*) are provided so as to be engaged with the rotary member 22 when four cartridges PK, PC, PM, and PY are in the region D where the four cartridges are mountable and detachable. In other words, the respective groove portions 19 are provided in accordance with the cartridges P supported by the tray 16.

Further, as illustrated in FIG. 7, when the tray 16 is in the mounting position in which the cartridges P are mounted in the image forming position PS, the groove portion 19*i* is provided at the position in which the rotary member 22 is engaged with the groove portion 19*i*. Thus, in the image forming state, the rotary member 22 is engaged with the groove portion 19*i*.

When the user draws the tray 16 forward (to the front side), as described with reference to FIGS. 5A to 5D of the first embodiment, the rotary member 22 is sequentially engaged with the groove portions 19*h*, 19*g*, 19*f*, and 19*e*. Thus, the clicking feeling may be obtained at the respective mounting and detaching positions of the cartridges P. FIG. 8 illustrates the mounting and detaching position for the cartridge PK accommodated most downstream in the drawing direction in the state in which the rotary member 22 is engaged with the groove portion 19*h*. In this case, the cartridge PK is mountable and detachable in the region D.

Figure 8:
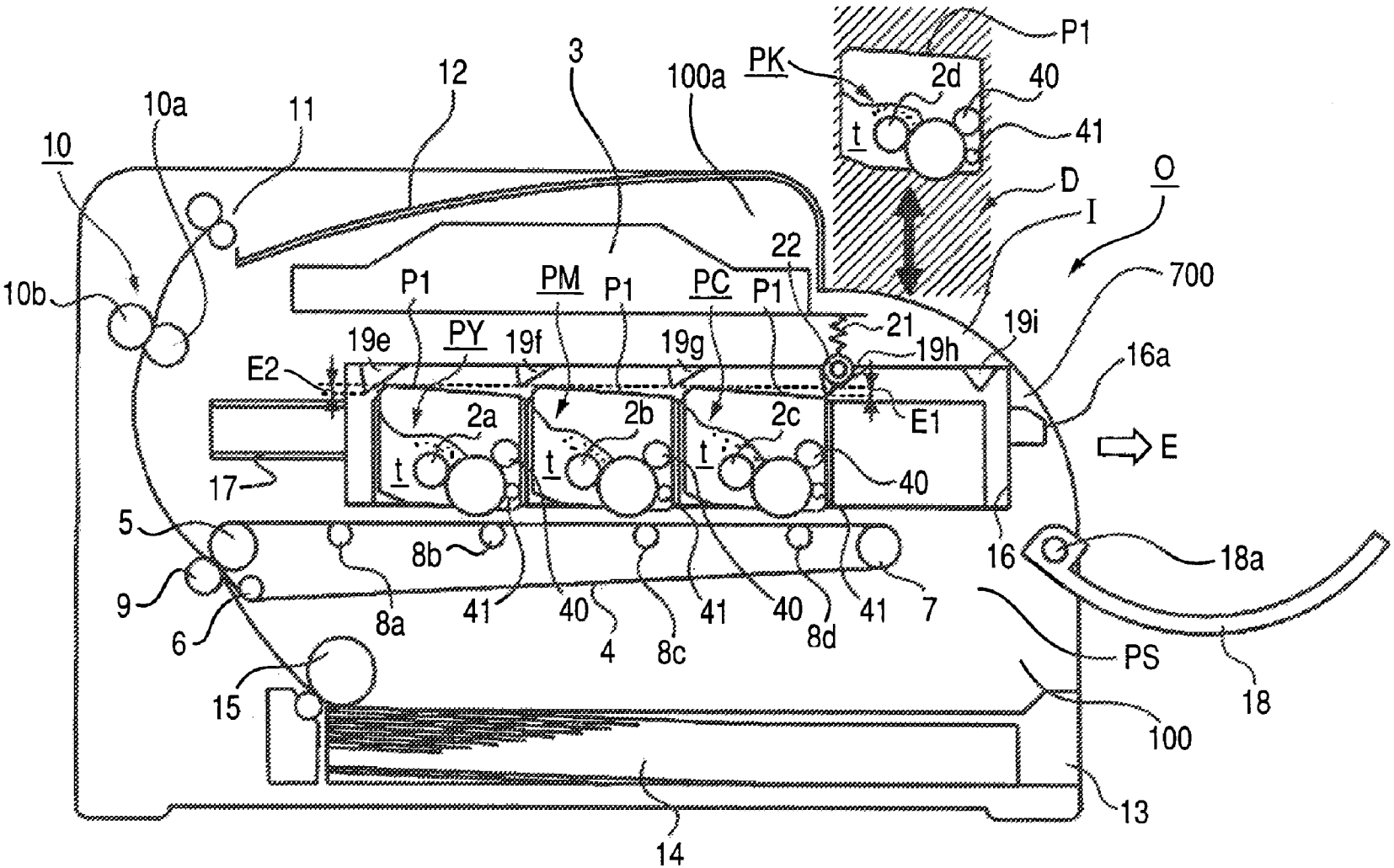
FIG. 8 is a sectional view illustrating how cartridge replacement is effected in the second embodiment.

Further, the groove portion 19*h* is formed to have a larger depth than the other groove portions 19*f* and 19*g* by a distance E1 illustrated in FIG. 8. Thus, the engagement force of the groove portion 19*h* with the rotary member 22 (force which is necessary when the rotary member 22 exits the groove portions 19) is larger than the engagement force of each of the other groove portions 19*f* and 19*g* with the rotary member 22. Accordingly, the user may easily recognize the mounting and detaching position for the cartridge PK which is known to be used most often.

In other words, when the cartridge PK reaches the mounting and detaching position, the force which is necessary to move the tray 16 becomes larger than that when the other cartridges PY, PC, and PM reach the mounting and detaching positions. That is, the clicking feeling becomes larger.

Further, the groove portion 19*e*, which is arranged in accordance with the cartridge PY accommodated (supported) in the most upstream in the drawing out direction X, is formed to have a larger depth than the other groove portions 19*f* and 19*g* by a distance E2 illustrated in FIG. 8. Thus, as in the case of the cartridge PK, the force (engagement force), which is necessary when the rotary member 22 exits the groove portion 19*e*, becomes larger. Accordingly, it is possible to prevent the tray 16 from being erroneously removed from the apparatus main body 100.

Note that, in this embodiment, it is satisfied that E2>E1, and the engagement force of the groove portion 19*e* is larger than that of the groove portion 19*h*. This prevents the tray 16 from being erroneously removed from the apparatus main body 100.

Third Embodiment

Figure 9:
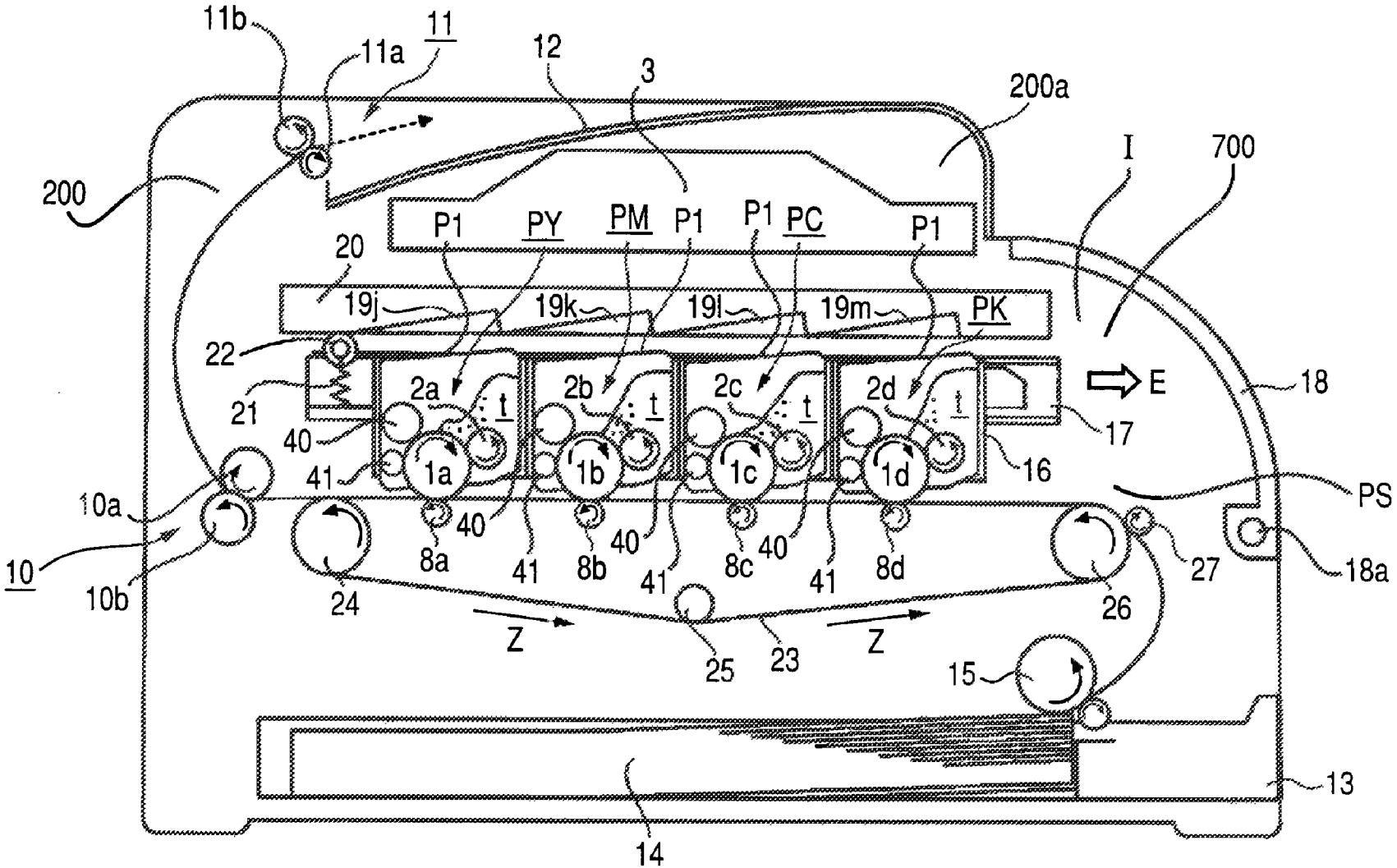
FIG. 9 is a sectional view of a general structure of an image forming apparatus according to a third embodiment.

Next, an image forming apparatus according to a third embodiment of the present invention will be described with reference to FIG. 9, FIG. 9 illustrates structure of the image forming apparatus according to this embodiment. In the following, a description will be provided with reference to FIG. 9. However, components having the same structure and operation as the first embodiment are denoted by the same reference symbols and the descriptions thereof are omitted.

The image forming apparatus 100*a* according to the first embodiment and the second embodiment primary-transfers the developer images formed on the photosensitive drums 1 onto the transfer belt 4. After that, the primary-transferred image is secondary-transferred onto the recording medium 14. As a result, an image is formed on the recording medium 14. Meanwhile, an image forming apparatus 200*a* according to this embodiment directly transfers the developer images formed on the photosensitive drums 1 onto the recording medium 14 to be conveyed by the transfer conveyance belt 23. In this way, the image is formed on the recording medium 14.

(Overall Structure of the Image Forming Apparatus)

In this embodiment, in the portion below the cartridges P (PY, PM, PC, and PK) mounted to the apparatus main body 200, the transfer conveyance belt 23 is arranged. The conveyance belt 23 is passed around a driving roller 24, a tension roller 25, and a driven roller 26 serving as the three shafts therefor so as to be rotated in the direction indicated by the arrow Z in FIG. 9. At a position on the most upstream side in the conveying direction Z of the conveyance belt 23, an attracting roller 27 is arranged while being opposed to the driven roller 26, with the conveyance belt 23 being interposed therebetween.

The recording medium 14 conveyed from the feeding roller 15 is sandwiched between the attracting roller 27 and the conveyance belt 23. Simultaneously, the bias voltage is applied to the attracting roller 27 which serves as the opposite pole of the grounded driven roller 26. As a result, the electric field is formed between the attracting roller 27 and the driven roller 26. Then, the conveyance belt 23 and the recording medium 14 are subjected to dielectric polarization so as to be provided with the electrostatic attractive force. In this way, the recording medium 14 is electrostatically attracted onto the surface of the conveyance belt 23.

The developer images of the respective colors, which are formed on the photosensitive drums 1, are transferred onto the recording medium 14 attracted to the conveyance belt 23 in a sequentially superimposed manner in accordance with the rotation of the conveyance belt 23. After that, the recording medium 14 is separated from the conveyance belt 23 so as to be conveyed to the nip portion of the fixing film 10*a* and the pressure roller 10*b*. At this portion, the recording medium 14 is heated and pressurized so that the developer images are fixed to the recording medium 14. The recording medium 14 on which the developer images are fixed is delivered onto the delivery tray 12 by the delivery roller pair 11

(Mounting and Detaching of the Cartridges)

Next, the drawing operation of the tray 16 (cartridge supporting member) according to this embodiment will be described.

As illustrated in FIG. 9, on the interior side surface, the abutment member 20 which has four groove portions (engaging portions) 19 (19*j*, 19*k*, 19*l*, and 19*m*) is arranged. That is, the abutment member 20 is provided in the apparatus main body 200. Further, on the rear side surface of the tray 16 and on the lower surface of the abutment member 20, the rotary member (pressure member) 22 which is pressed by the elastic force of the elastic member 21 is arranged.

When the tray 16 is drawn out of the apparatus main body 200, positions of the tray at which the groove portions 19*j*, 19*k*, 19*l*, and 19*m* are opposed to the rotary member 22 are positions at which the cartridges P are present at the mounting and detaching position, respectively, that is, the positions of the tray at which the cartridges P reach the mounting and detaching position, respectively. Thus, when the user draws out the tray 16 to the front side, the rotary member 22 is sequentially engaged with the groove portions 19*j*, 19*k*, 19*l*, and 19*m*. Then, the clicking feeling is provided at the mounting and detaching positions for the cartridges P. That is, the load required for the movement of the tray 16 is larger than the load of the case in which the groove portions 19 and the rotary member 22 are not engaged with each other. Further, in this embodiment, the groove portions 19 adjacent to each other are continuously formed. Thus, simultaneously with exiting (being separated from) one of the groove portions (groove portion 19*j*, for example), the rotary member 22 enters the next groove portion (groove portion 19*k*, for example). In this way, with the elastic force (urging force) of the elastic member 21, the tray 16 is constantly imparted with the drawing force directed to the front side (in the drawing direction). Therefore, the force of the user necessary for the drawing operation is reduced.

As described above, in this embodiment, the rotary member 22 is engaged with the groove portions 19, whereby the load required for the movement of the tray 16 at the mounting and detaching positions is made larger than the load required for the movement thereof at positions other than the mounting and detaching positions.

In the embodiments described above, the tray 16 is moved in the horizontal direction with respect to the installation surfaces (not shown) of the apparatus main bodies 100 and 200. However, in this embodiment, the movement direction is not limited thereto. The tray 16 may linearly move, for example, diagonally upward or diagonally downward with respect to the installation surfaces (not shown) of the apparatus main bodies 100 and 200. The tray 16 linearly moves in the direction orthogonal to the longitudinal direction of the cartridges P supported (accommodated or mounted) thereby. Note that the longitudinal direction of the cartridges P corresponds to the longitudinal direction of the photosensitive drum 1 or the longitudinal direction of the developing roller serving as the developing means 2.

The following embodiment relates to an example in which the tray 16 linearly moves in the direction perpendicular to the installation surface (not shown) of the apparatus main body.

Fourth Embodiment

Figure 10:
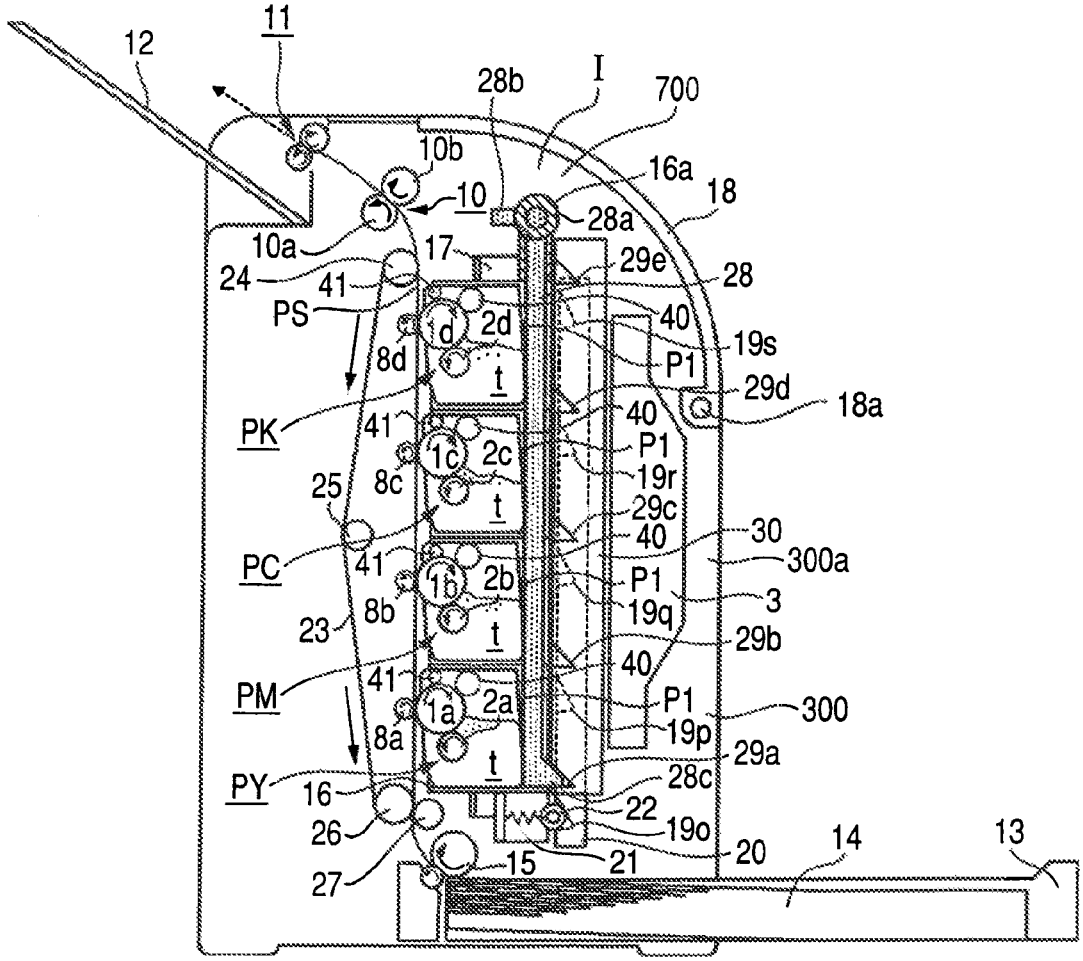
FIG. 10 is a sectional view of a general structure of an image forming apparatus according to a fourth embodiment.

Next, an image forming apparatus according to a fourth embodiment of the present invention will be described with reference to FIG. 10, FIG. 11, and FIGS. 12A and 12B. FIG. 10 illustrates a structure of the image forming apparatus according to this embodiment. In the following, a description will be provided with reference to FIG. 10. However, a procedure for the image formation is similar to that of the third embodiment, and components having the same structure and operation are denoted by the same reference symbols and the descriptions thereof are omitted.

In an image forming apparatus 300*a* of this embodiment, the cartridges P (PY, PM, PC, and PK) are arranged in the substantially vertical direction. The tray (cartridge supporting member) 16 is regulated by the rail member 17 in order to draw the tray in the substantially vertical direction. A grip portion 16*a* is provided at the upper portion of the tray 16 in order to draw the tray 16 to the outside of an apparatus main body 300. To the side surface of the grip portion 16*a*, there is attached a stopper 28 which regulates the movement of the tray 16 in the gravity direction for the purpose of preventing the falling of the tray 16 due to its own weight. The image forming apparatus 300*a* according to this embodiment has an advantage of being installed within a smaller area when compared with the structure in which the tray 16 is drawn to the outside of the apparatus main body 300.

The stopper 28 is attached to the grip portion 16*a* rotatably around a fulcrum portion 28*a* as the rotation center provided at the upper portion of the stopper 28. The stopper 28 is urged by the elastic means (not shown) in the counterclockwise direction in FIG. 10. Further, on the interior side surface of the apparatus main body 300, the abutment member 20 which has five groove portions 19*o*, 19*p*, 19*q*, 19*r* and 19*s* is arranged at the position of being opposed to the rotary member 22. Still further, on the interior left side surface of the apparatus main body 300, a regulation member 30 having five regulation grooves 29*a*, 29*b*, 29*c*, 29*d*, and 29*e* which are engaged with a locking portion 28*c* provided at the lower end of the stopper 28 is arranged.

In FIG. 10, the rotary member 22 is engaged with the groove portion 190 of the abutment member 20, and further, the stopper 28 is engaged with the regulation groove 29*a* of the regulation member 30. In this state, the cartridges P are supported at the position of performing the image formation.

When taking out the tray 16, the user grips the grip portion 16*a* and draw out the tray 16 in the upper direction. In this case, a protruding portion 28*b* provided at the upper portion of the stopper 28 is rotated clockwise in FIG. 10. As a result, the stopper 28 is disengaged from the regulation groove 29*a*.

Figure 11:
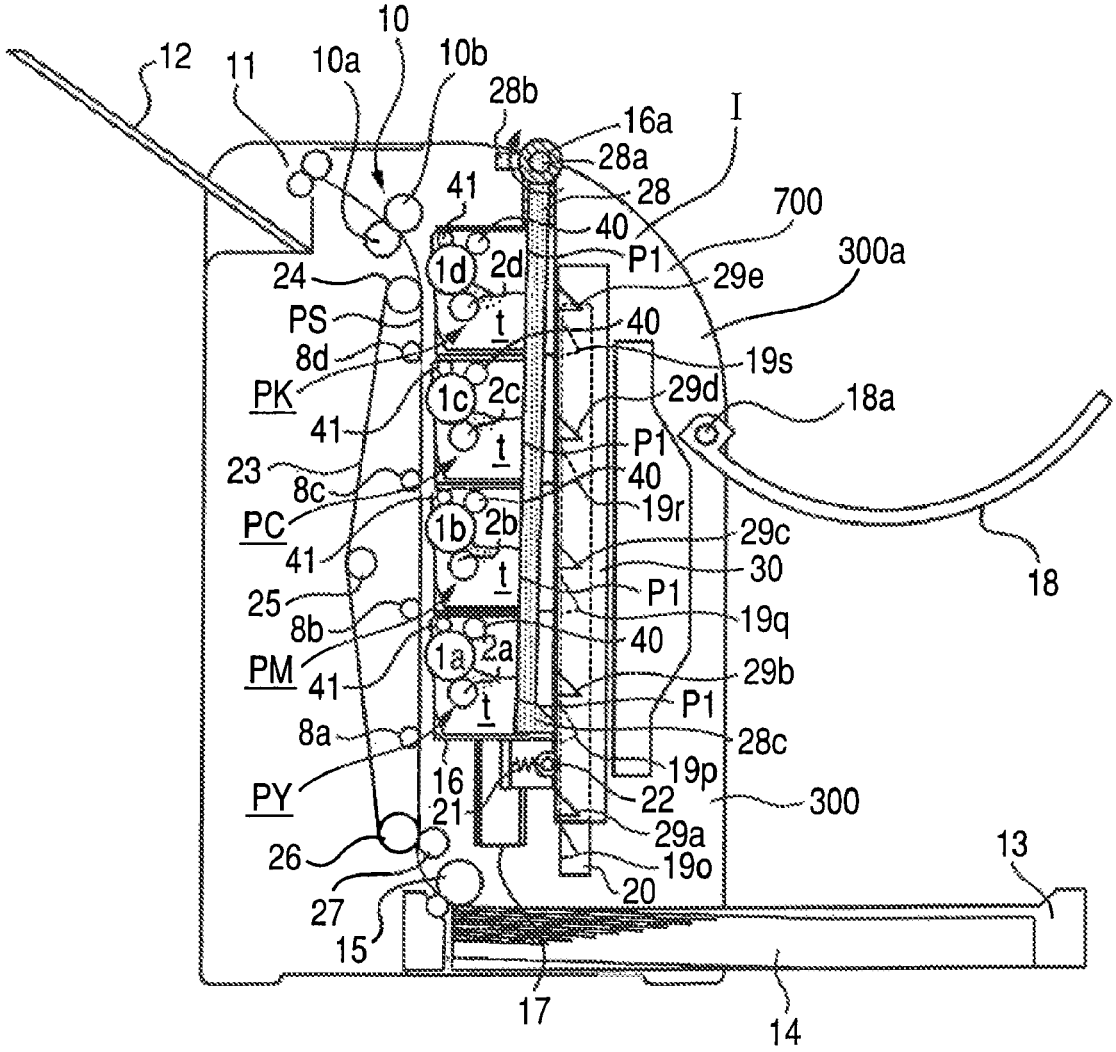
FIG. 11 is a sectional view illustrating a stopper according to the fourth embodiment as released.

FIG. 11 illustrates a disengaged state of the stopper 28 in the process of drawing out the tray 16. The tray 16 is drawn out of the apparatus main body 300 in this state. In this drawing process, the rotary member 22 is sequentially engaged with the groove portions 19*p*, 19*q*, 19*r* and 19*s*. In this manner, the mounting and detaching positions of the cartridges P may be recognized.

Figure 12A:
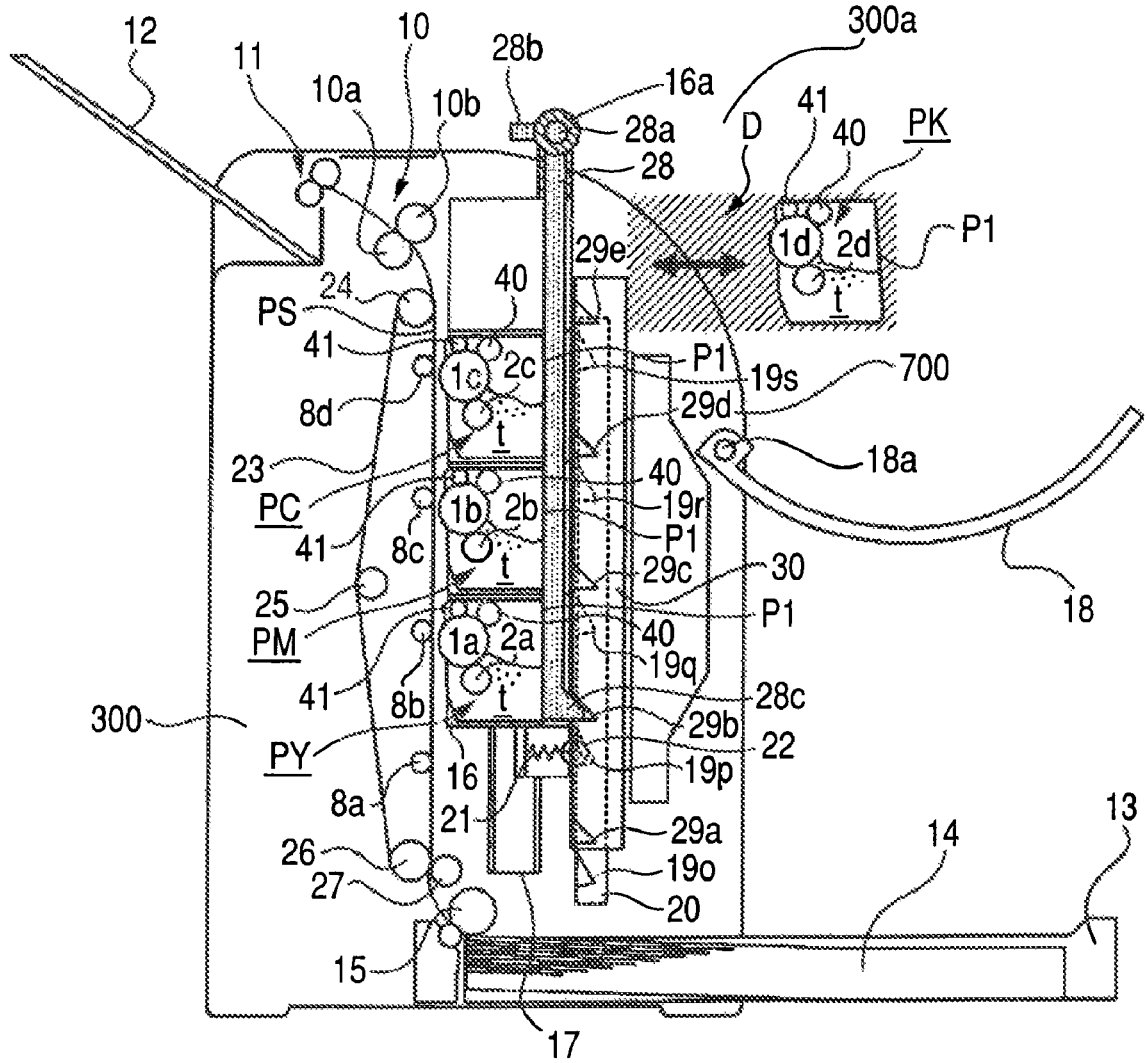
FIG. 12A is a sectional view illustrating how cartridge replacement is effected in the fourth embodiment.

FIG. 12A illustrates the mounting and detaching position of the cartridge PK in the case where the rotary member 22 is engaged with the groove portion 19*p*. The regulation grooves 29 (29*b*, 29*c*, 29*d*, and 29*e*) are arranged correspondingly to the mounting and detaching positions of the cartridges. In this context, as a result of releasing the grip portion 16*a* and the protruding portion 28*b*, the stopper 28 is engaged with the regulation groove 29*b*. With this structure, the falling of the tray 16 due to its own weight is prevented. Then, the tray 16 is supported at the mounting and detaching position for the cartridge PK. As a result, the cartridge PK may be mounted and detached in a front surface opened region D.

The other cartridges PY, PC, and PM also may be mounted to and detached from the tray 16 at the mounting and detaching positions for the cartridges in the same procedure. When the tray 16 is to be accommodated, the protruding portion 28*b* is rotated clockwise so as to release the stopper 28. In this manner, the tray 16 is moved downward. Then, at the position where the rotary member 22 is engaged with the groove portion 19*o*, the grip portion 16*a* and the protruding portion 28*b* are released. As a result, the stopper 28 is engaged with the regulation groove 29*a*. After that, the tray 16 is stopped so that the cartridges P are supported at the image forming position.

Figure 12B:
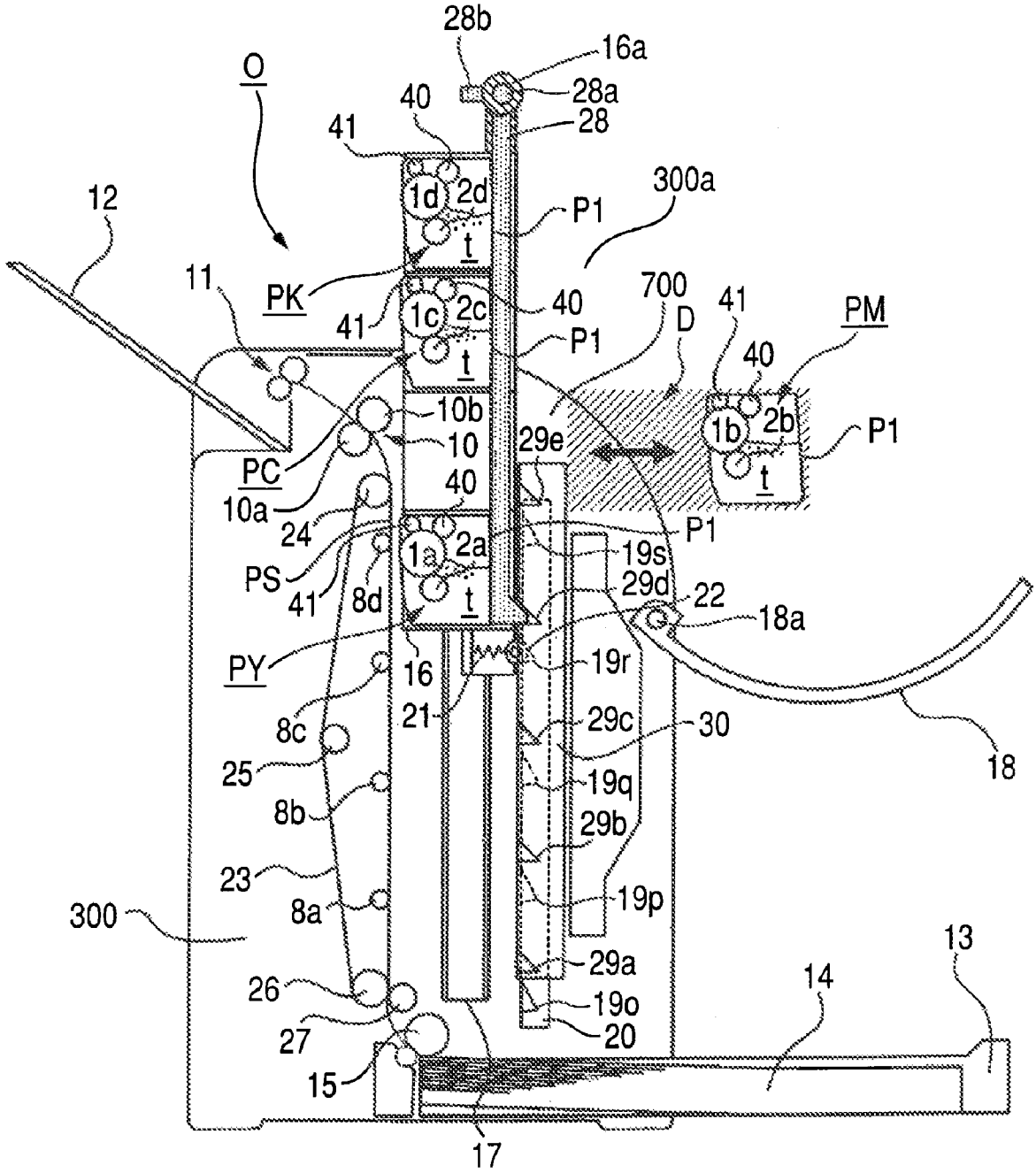
FIG. 12B is a sectional view illustrating how cartridge replacement is effected in the fourth embodiment, illustrating the cartridge tray as drawn out to the exterior of the apparatus main body.

FIG. 12B illustrates a state in which the tray 16 is drawn out of the apparatus main body 300 so as to be positioned at an outside position O. FIG. 12B illustrates the mounting and detaching position for the cartridge PM containing a magenta developer "t" in the case where the rotary member 22 is engaged with the groove portion 19*r*.

Note that, in order to decrease the speed of falling of the tray 16 due to its own weight, dampers or the like may be used.

The image forming apparatuses 100*a*, 200*a*, and 300*a* to which the above-mentioned embodiments are applied will be described as follows.

That is, when the tray 16 is moved from the inside position to the mounting and detaching positions and at least one of the cartridges P reaches the mounting and detaching position, the rotary member (pressure member) 22 is engaged with the groove 19 (engaging portions). With this structure, the load required for the movement of the tray 16 is made larger than the load of the case in which the groove 19 and the rotary member 22 are not engaged with each other. As a result, the clicking feeling can be generated.

Further, the groove 19 and the rotary member 22 are provided for each of the cartridges P in accordance with the plurality of cartridges P supported by the tray 16. With this structure, when the cartridges P reach the mounting and detaching positions, the clicking feeling may be generated.

Still further, the rotary member 22 is elastically urged by the spring (elastic member) 21 in the direction of the groove 19 and is rotatable about the shaft 22*b*. With this structure, the engagement and detachment between the groove 19 and the rotary member 22 may be smoothly performed.

Yet further, the engagement force between the rotary member 22 and the groove 19 when the cartridge PK, among the plurality of cartridges P, containing a black developer reaches the mounting and detaching position is larger than the engagement force between the rotary member 22 and the groove 19 in the case where at least one of the other cartridges is positioned at the mounting and detaching position (second embodiment).

As a result, when the cartridge PK replaced at frequency higher than that of the other cartridges reach the mounting and detaching position, the clicking feeling may be generated (second embodiment).

Further, when the cartridge, among the plurality of cartridges P, which is provided most upstream in the movement direction E of the tray 16 reaches the mounting and detaching position, the engagement force between the rotary member 22 and the groove 19 is larger than the engagement force between the rotary member 22 and the groove 19 when at least one of the other cartridges reaches the mounting and detaching position (second embodiment).

As a result, the user may recognize that the drawing out position of the tray 16 is the final position with the clicking feeling (second embodiment).

Fifth Embodiment

Figure 13:
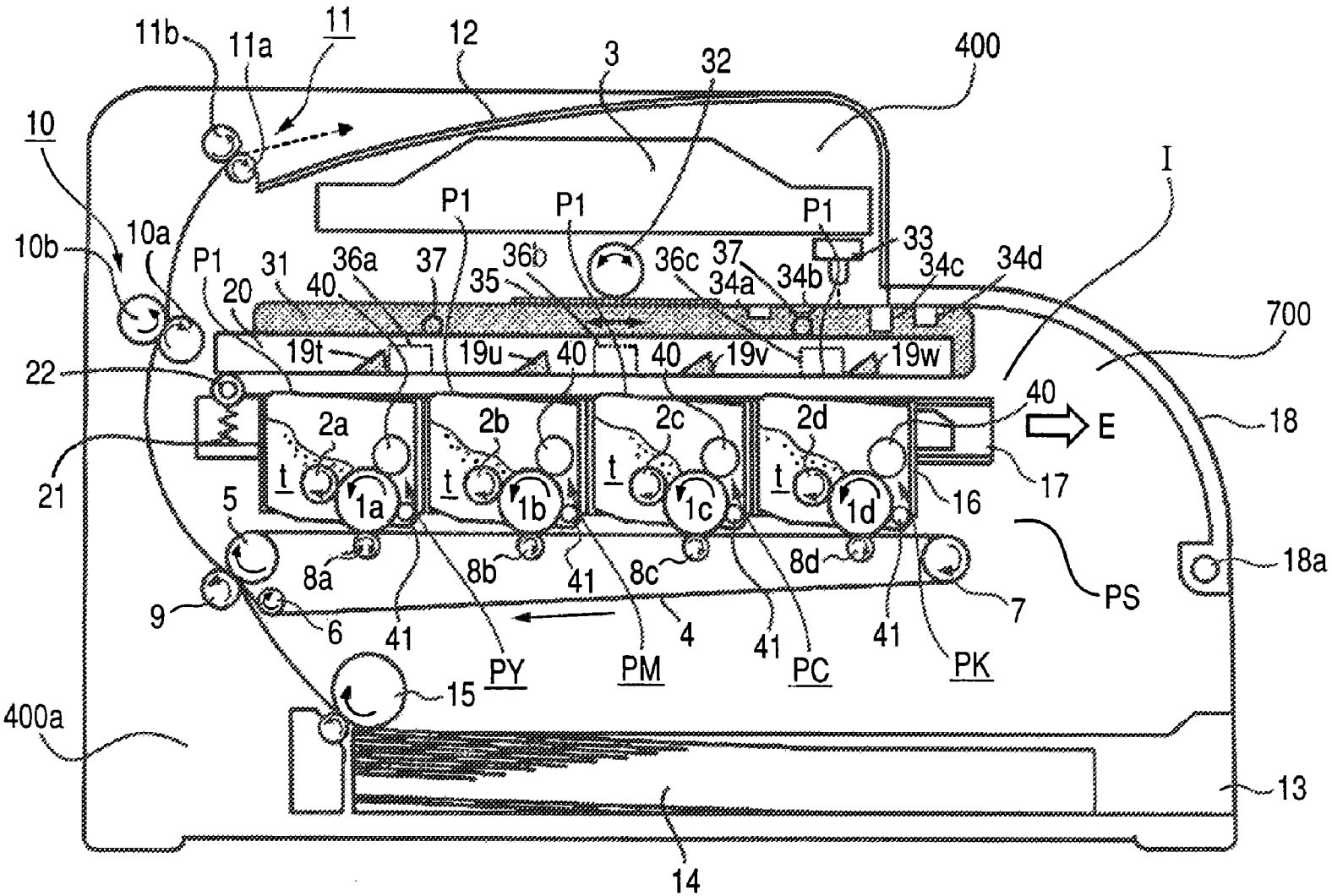
FIG. 13 is a sectional view of a general structure of an image forming apparatus according to a fifth embodiment.

Next, an image forming apparatus according to a fifth embodiment of the present invention will be described with reference to FIGS. 13 and 18. FIG. 13 illustrates a structure of the image forming apparatus according to this embodiment. In the following, a description will be made with reference to FIG. 13. However, a procedure for the image formation is similar to that of the first embodiment, and components having the same structure and operation are denoted by the same reference symbols and the descriptions thereof are omitted.

In this embodiment, the cartridges P to be replaced in accordance with the reduction of the remaining amount of the developer "t" are automatically discriminated. Then, when the user draws out the tray 16 from an apparatus main body 400, the clicking feeling is provided when the cartridges P to be replaced reaches the mounting and detaching positions. That is, when the cartridges P unnecessary to be replaced reach the mounting and detaching positions, it is unnecessary to provide the clicking feeling. Thus, the user may more reliably recognize that the cartridges P to be replaced reach the mounting and detaching positions. In this way, in this embodiment, the cartridges to be replaced may be discriminated so that the load required for drawing out the tray 16 is large when the cartridge to be replaced reach the mounting and detaching position for the cartridge.

In this embodiment, at the position corresponding to both the ends of the tray 16 inside the apparatus main body 400, the abutment member 20 is fixedly arranged. The abutment member 20 is provided with the plurality of groove portions (engaging portions, first groove portions) 19. In this embodiment, four groove portions 19 (19*t*, 19*u*, 19*v*, and 19*w*) are provided correspondingly to the mounting and detaching positions for the cartridges P. Further, a movable member 31 slidable in the front-rear direction (drawing direction E) is provided adjacently to the abutment member 20. Note that the abutment member 20 and the movable member 31 are provided in the apparatus main body 400.

A rack 35 is provided on the upper surface of the movable member 31. The rack 35 meshes with a gear 32. With this structure, the movable member 31 is slid in accordance with the rotation of the gear 32. In addition, a detection sensor 33 for detecting the portion of the movable member 31 is provided. Note that the gear 32 and the detection sensor 33 are provided in the apparatus main body 400.

The movable member 31 is provided with position detection groove portions 34 (34*a*, 34*b*, 34*c*, and 34*d*) on the upper surface thereof, and provided with lower groove portions (engaging portions, second groove portions) 36 (36*a*, 36*b*, and 36*c*). In addition, bosses 37 are provided on both the lateral surfaces of the movable member 31. The lower surface of the movable member 31 is arranged substantially flush with the lower surface of the abutment member 20.

Figure 14:
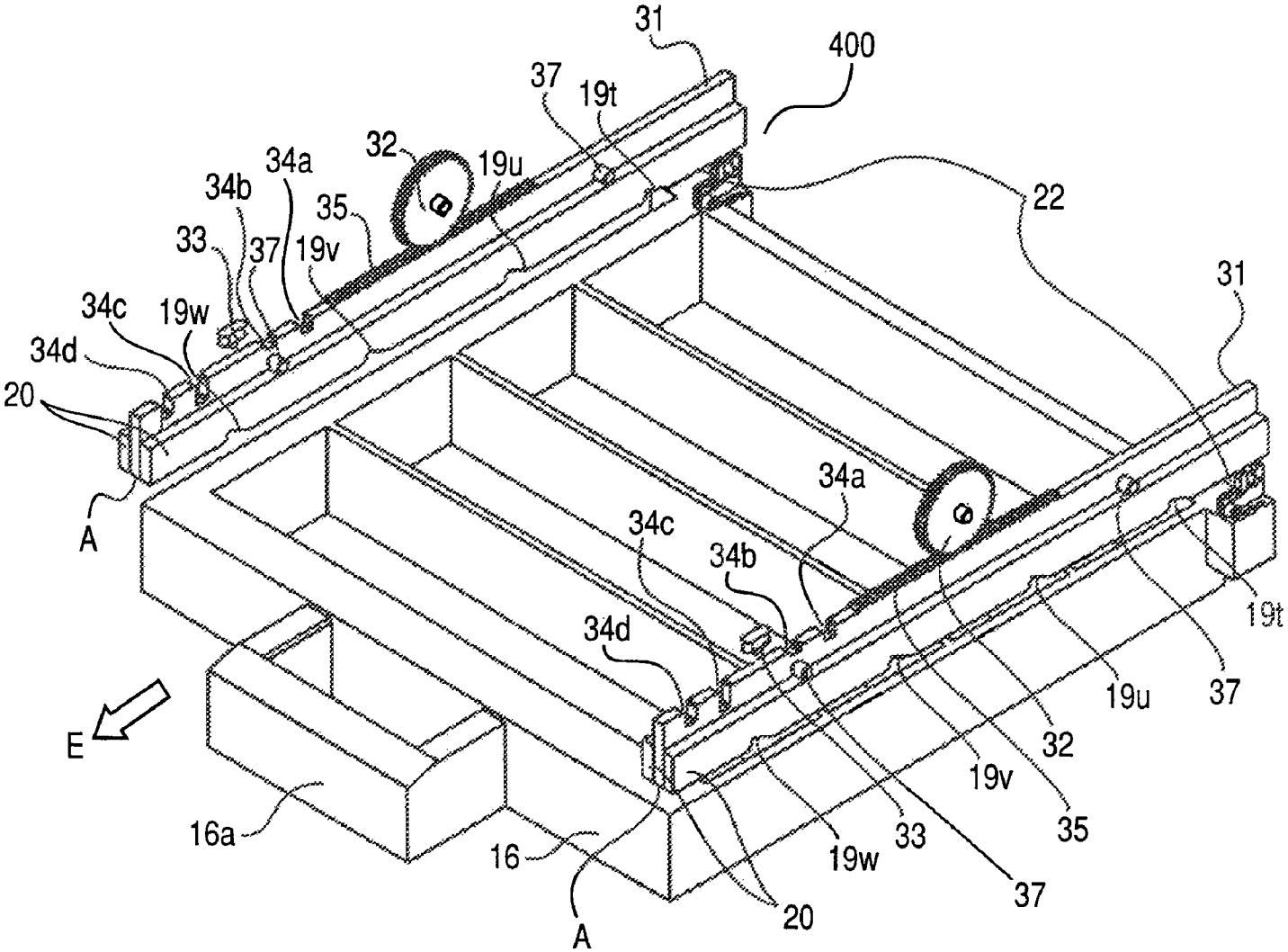
FIG. 14 is a perspective view illustrating an arrangement of a cartridge tray and an abutment member according to the fifth embodiment.
Figure 15A:
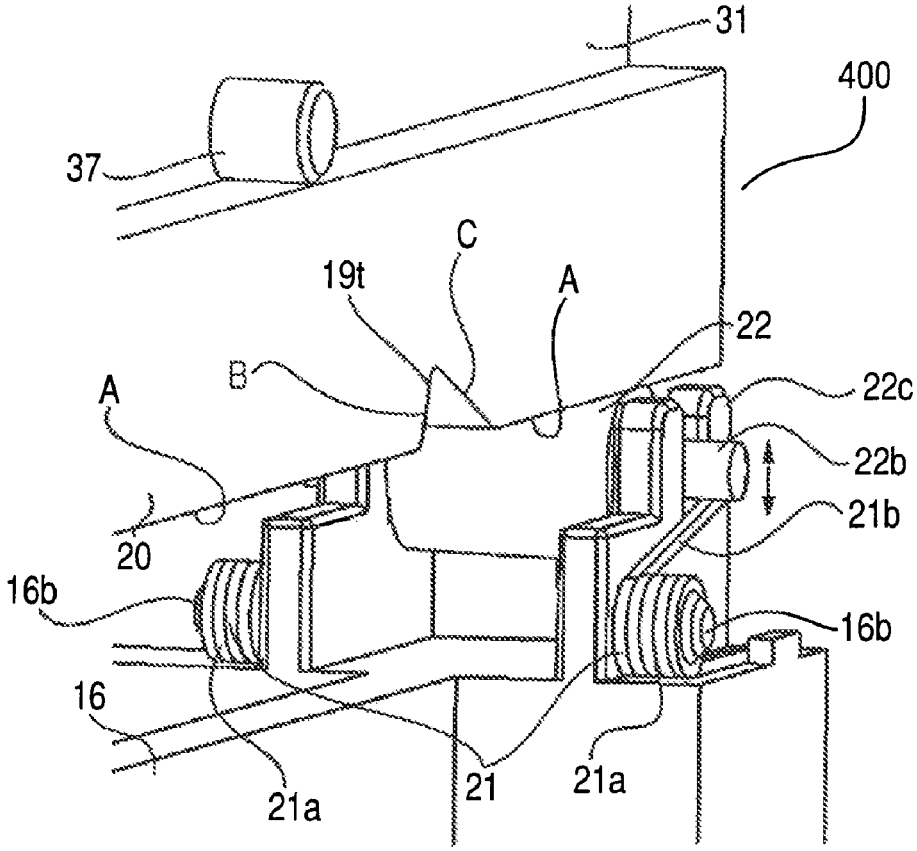
FIGS. 15A and 15B are perspective views illustrating an arrangement of an urging member, a rotary member, and the abutment member according to the fifth embodiment.
Figure 15B:
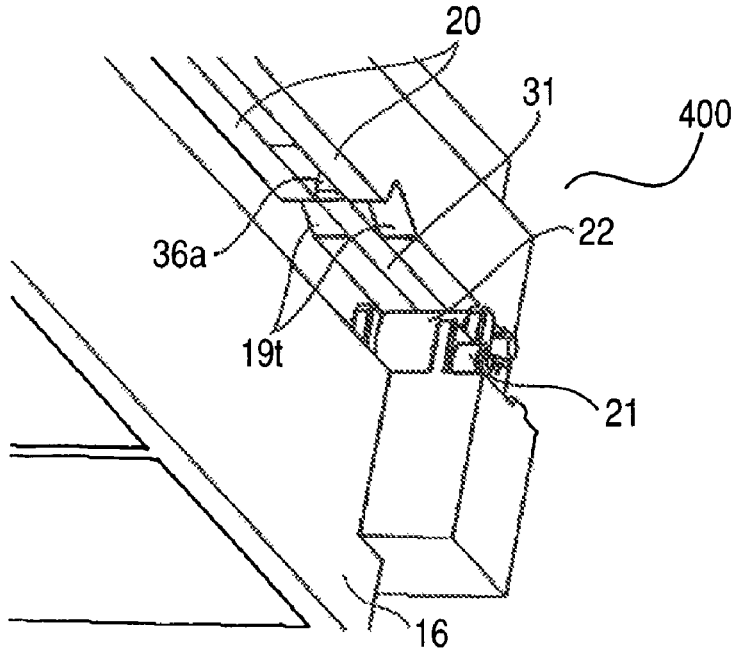

Further, as illustrated in FIGS. 14 and 15B, the abutment members 20 are arranged in parallel to both the lateral surfaces of the movable member 31, respectively, and fixed to the apparatus main body 100 through a member (not shown). When the driving force is transmitted from a motor (driving source) M (FIG. 18) to the gear 32, the movable member 31 is moved through the rack 35. In this case, the movable member 31 moves in a substantially horizontal direction because the bosses 37 are held in contact with the upper surface of the abutment members 20 so as to slide.

Still further, the lower groove portions 36 are arranged at intervals different from those of the groove portions 19 of the abutment member 20. In addition, the widths of the lower groove portions 36 are substantially the same as the widths of the groove portions 19 provided in the tray 16. Therefore, in the case where the positions in the front-rear direction of the lower groove portions 36 and the groove portions 19 are not aligned with each other, the rotary member 22 is obstructed by the movable member 31 and not engaged with the groove portions 19 even when the tray 16 is drawn out. Meanwhile, when the movable member 31 is moved so that the positions in the front-rear direction of a lower groove portion 36 and a groove portion 19 are aligned with each other, the rotary member 22 can be engaged with only that groove portion 19. Then, the tray 16 is supported at that position. That is, as a result of the sliding of the movable member 31, the rotary member 22 is unable to be engaged with the other groove portions except for one desired groove portion.

Note that, in this embodiment, though the abutment members 20 are arranged along both the lateral surfaces of the movable member 31, respectively, as illustrated in FIG. 14, an abutment member 20 may be provided on only one side.

Figure 18:
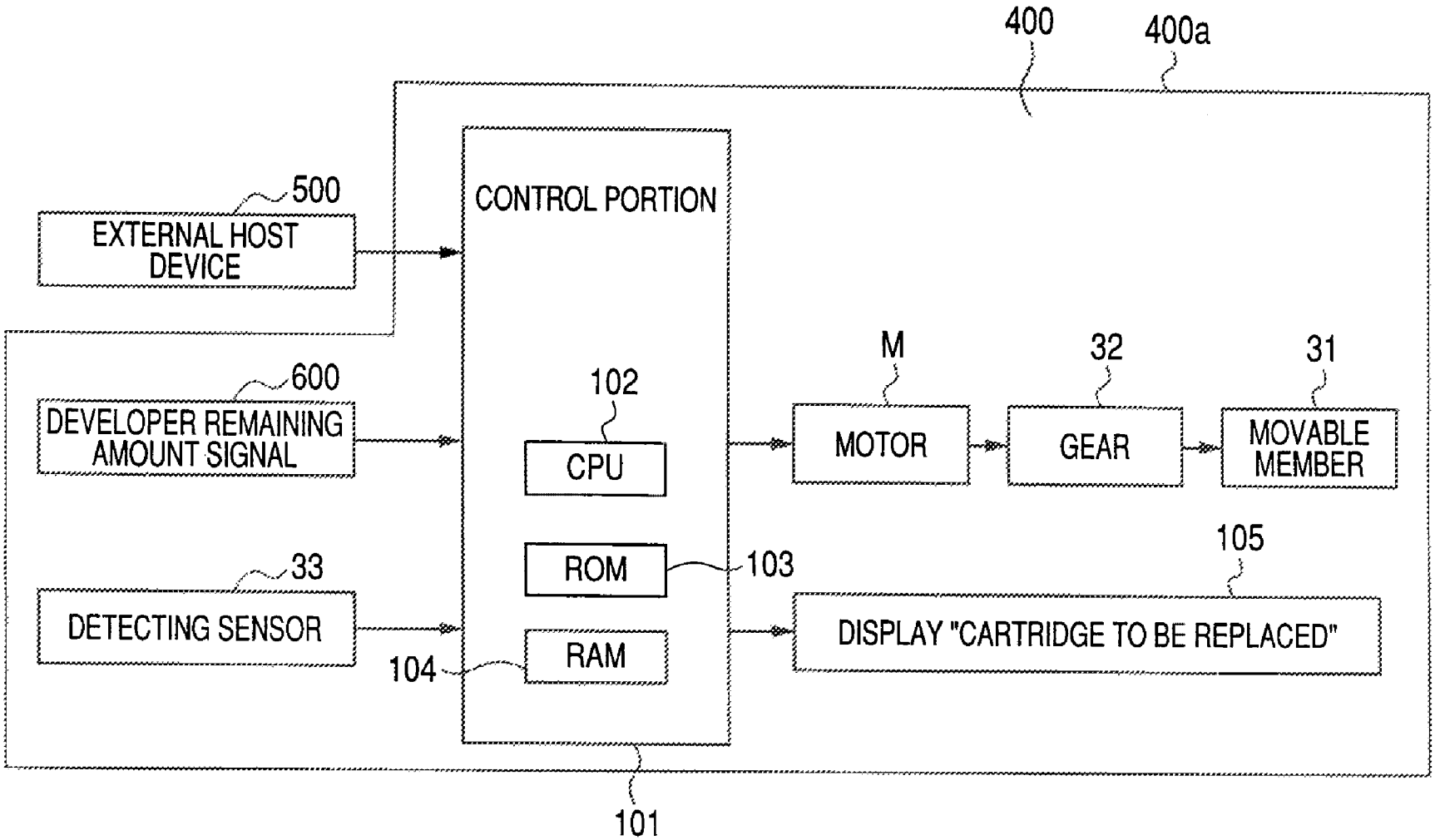
FIG. 18 is a block diagram illustrating a control portion of an image forming apparatus to which an embodiment of the present invention is applied.

In this embodiment, by the developer remaining amount signal according to the developer remaining amount of each of the cartridges P, the position of the movable member 31 is controlled by the control portion 101 (FIG. 18). Thus, the developer "t" is consumed and the cartridge necessary to be replaced is selected. Then, when the user draws out the tray 16 and the cartridge reaches the mounting and detaching position, the clicking feeling is provided. Only at the position, a necessary force with which a user draws out the tray 16 is made larger so that the tray 16 can be stopped. Thus, the user may unconsciously recognize the cartridge necessary to be replaced. In addition, the rotary member 22 is not engaged with the groove portions 19 in the unnecessary positions. Accordingly, the tray 16 moves smoothly, and the user can stop drawing of the tray 16 in the state in which the cartridge P necessary to be replaced reaches the mounting and detaching position. According to this embodiment, those components may be controlled by the control portion 101 (FIG. 18). Therefore, the user can easily recognize the cartridge P necessary to be replaced, improving an operability of replacing the cartridges P.

Figure 16A:
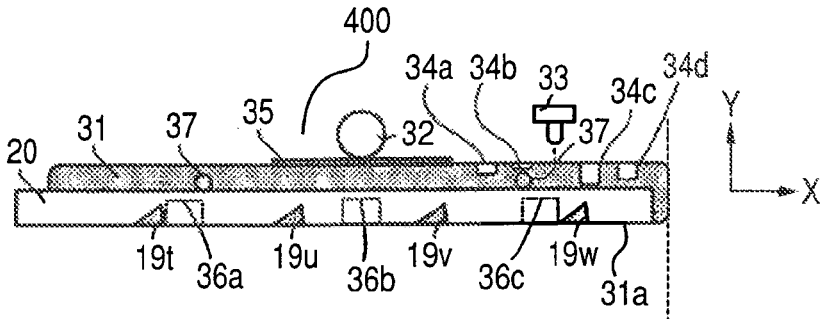
FIGS. 16A, 16B, 16C, 16D, and 16E are sectional views illustrating a position of a movable member at the time of cartridge mounting and detaching in the fifth embodiment.
Figure 16B:
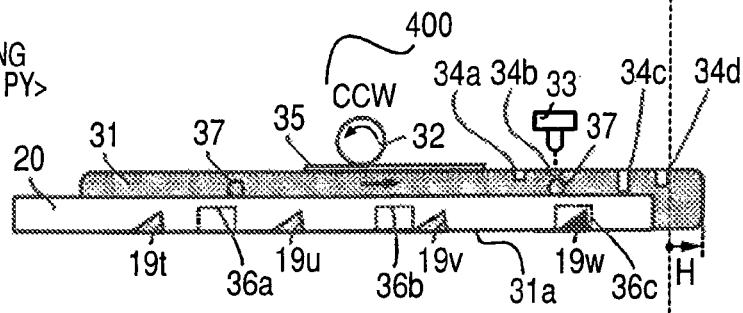

Here, with reference to FIGS. 16A, 16B, 16C, 16D, 16E, and 17, there will be described an example of the procedure in which the cartridge to be replaced is selected and the cartridge is stopped at the mounting and detaching position. FIGS. 16A to 16E illustrate the positions of the movable member at the time of mounting and detaching of the respective cartridges. FIG. 17 illustrates a flowchart for selecting the positions for mounting and detaching the cartridges. FIG. 18 is a block diagram.

In this embodiment, when the cartridge, which is detected to be out of developer, moves to the mounting and detaching position by the detecting means for detecting the developer remaining amounts of the cartridges P, the rotary member 22 is engaged with the groove portion 19 corresponding to the mounting and detaching position of the detected cartridge P. Thus, in this embodiment, the developer "t" is consumed, and the clicking feeling is automatically provided when the cartridge to be replaced reaches the mounting and detaching position.

First, as illustrated in FIG. 17, by a detection means (not shown), the remaining amount of the developer in each of the cartridges is detected (S1). When the cartridge PY runs out of the remaining developer and the replacement thereof is necessary (S2), as illustrated in FIG. 16B, the gear 32 is rotated counterclockwise, and the movable member 31 is moved in the positive direction of X-axis by a distance H (S3). As a result, positions of the lower groove portion (second groove portion) 36*c* and the groove portion (first groove portion) 19*w* are aligned with each other, whereby the rotary member 22 engages only with the groove portion 19*w* when performing drawing operation of the cartridge tray 16. Accordingly, the clicking feeling is generated only at the mounting and detaching position for the cartridge PY.

Figure 16C:
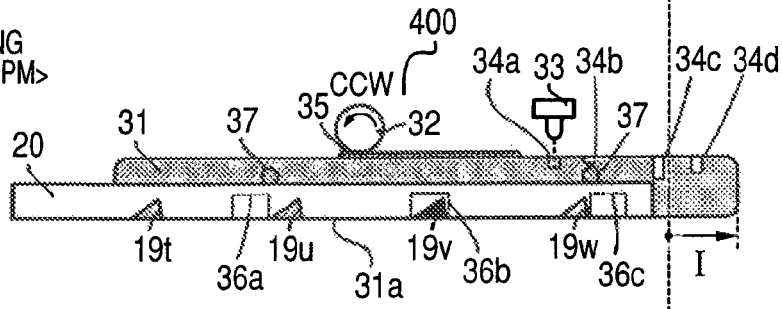
Figure 16D:
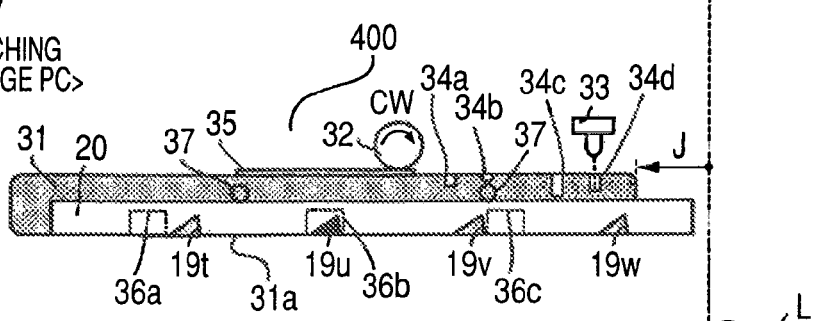
Figure 16E:
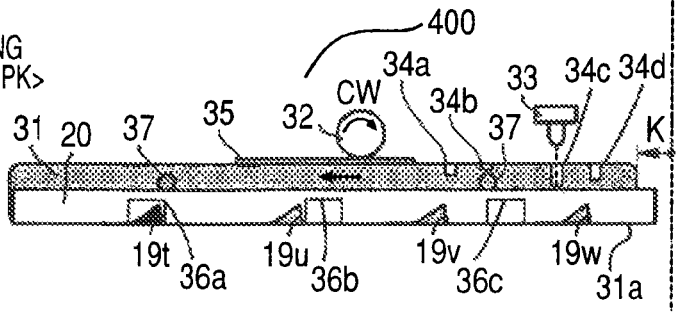
Figure 17:
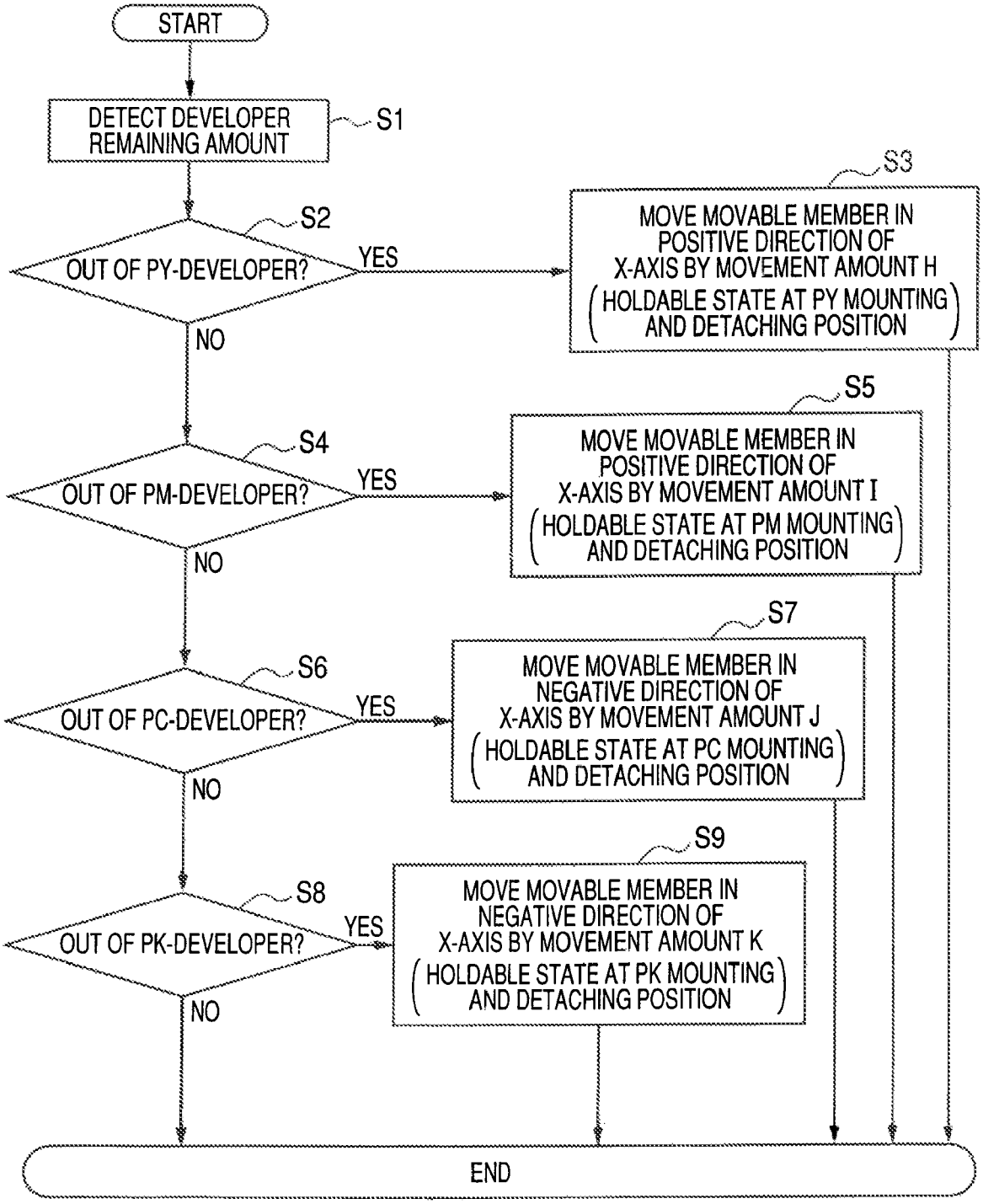
FIG. 17 is a flowchart for selecting a mounting and detaching position for the cartridge.

Similarly in the other cartridges PM, PC, and PK, as illustrated in FIGS. 16C, 16D, and 16E, by a driving force of the motor M, the movable member 31 is moved in a predetermined direction by a predetermined amount. In this manner, the tray 16 is moved in a predetermined direction by a predetermined amount. Then, the cartridge which is necessary to be replaced is moved to the mounting and detaching position for the cartridge (S4 to S9). Further, as illustrated in the flowchart of FIG. 17, in a selecting process of the mounting and detaching position, the toner remaining mount of the cartridges are detected in the order from the cartridge disposed in the upstream side in the drawing direction. Therefore, even when the replacement of the plurality of cartridges is necessary, the movable member 31 is held at the mounting and detaching position for the cartridge on the upstream side. Accordingly, the tray 16 is stopped at the position where the plurality of cartridges P which are necessary to be replaced are all mountable and detachable.

Note that the detecting sensor 33 is fixed to the apparatus main body 400 side, and capable of detecting a distance to the upper surface of the movable member 31. As illustrated in FIGS. 16A to 16E, the detecting sensor 33 detects, at the mounting and detaching positions for the cartridge P, the distance to the position detecting grooves 34 (34*a*, 34*b*, 34*c*, and 34*d*) formed on the upper surface of the movable member 31. Each of the position detecting grooves 34 has a different depth from each other. Therefore, the position of the movable member 31 may be detected by the output value of the detecting sensor 33. Note that, as another detecting method, there may be adopted a method in which the home position is detected, whereby the movement amount therefrom is controlled by the driving amount of the motor which rotates the gear 32.

Note that, FIG. 16A illustrates an initial state (standby state) of the movable member 31. That is, the end portion of the movable member 31 is positioned at a reference position L. In this state, positions of the lower groove portions 36 and the groove portions 19 are not aligned with each other.

FIG. 16B illustrates a state where the movable member 31 is positioned at the mounting and detaching position for the cartridge PY. From the initial state illustrated in FIG. 16A, by rotating the gear 32 counterclockwise, the movable member 31 is moved in the positive direction of the X-axis of FIG. 16B by the distance H. That is, the end portion of the movable member 31 is deviated from the reference position L by the distance H. As a result, the positions of the lower groove portion 36*c* and the groove portion 19*w* are aligned with each other in the direction orthogonal to the moving direction of the movable member 31. As a result, the user may get the clicking feeling in the case where the cartridge PY reaches the mounting and detaching position when the user draws the tray 16.

FIG. 16C illustrates a state where the movable member 31 is positioned at the mounting and detaching position for the cartridge PM. From the initial state illustrated in FIG. 16A, by rotating the gear 32 counterclockwise, the movable member 31 is moved in the positive direction of the X-axis of FIG. 16C by the distance I. That is, the end portion of the movable member 31 is deviated from the reference position L by the distance I. As a result, the positions of the lower groove portion 36*b* and the groove portion 19*v* are aligned with each other in the direction orthogonal to the moving direction of the movable member 31. As a result, the user may obtain the clicking feeling in the case where the cartridge PM reaches the mounting and detaching position when the user draws the tray 16.

FIG. 16D illustrates a state where the movable member 31 is positioned at the mounting and detaching position for the cartridge PC. From the initial state illustrated in FIG. 16A, by rotating the gear 32 clockwise, the movable member 31 is moved in the negative direction of the X-axis of FIG. 16D by the distance J. That is, the end portion of the movable member 31 is deviated from the reference position L by the distance J in an opposite direction as in the case of FIGS. 16B and 16C. As a result, the positions of the lower groove portion 36*b* and the groove portion 19*u* are aligned with each other in the direction orthogonal to the moving direction of the movable member 31. As a result, the user may obtain the clicking feeling in the case where the cartridge PC reaches the mounting and detaching position when the user draws the tray 16.

FIG. 16E illustrates a state in which the movable member 31 is positioned at the mounting and detaching position for the cartridge PK. From the initial state illustrated in FIG. 16A, by rotating the gear 32 clockwise, the movable member 31 is moved in the negative direction of the X-axis of FIG. 16E by a distance K. That is, the end portion of the movable member 31 is deviated from the reference position L by the distance K in the opposite direction as in the cases of FIG. 16B and FIG. 16C. With this, the positions of the lower groove portion 36*a* and the groove portion 19*t* are aligned with each other in the direction orthogonal to the movement direction of the movable member 31. With this, when the user draws out the tray 16, the user can obtain a clicking feeling when the cartridge PK reaches the mounting and detaching position. Here, FIG. 18 is a block diagram illustrating the control portion 101 of an image forming apparatus 400*a* to which the above-mentioned embodiment is applied.

The respective portions of the control portion 101 are, for example, controlled by a CPU 102 such as a microprocessor. In the control portion 101, in addition to the CPU 102, there are provided a ROM 103 for storing a control program of the CPU 102 and various data, a RAM 104 for temporarily storing various data as a work area of the CPU 102, and the like.

Note that, a control program for executing processes of the flow chart illustrated in FIG. 17 is stored in the ROM 103.

To the control portion 101, a signal from an external host apparatus 500, the developer remaining amount signal 600, a signal from the detection sensor 33, and the like are input. Then, the control portion 101 controls a rotation direction and a rotation amount of the motor M on the basis of the developer remaining amount signal 600 and the signal from the detection sensor 33. Then, the control portion 101 controls the movement direction and a movement amount of the movable member 31 through the gear 32 that rotates in response to transmission of a driving force from the motor M. Further, the control portion 101 displays the cartridge to be replaced on a display portion (not shown) (illustrated in FIG. 18 by a reference numeral 105). The cartridge to be replaced means a cartridge in which the remaining amount of the developer "t" within the cartridge P becomes less than a preset amount.

Note that, as the structure to detect the remaining amount of the developer "t" within the cartridge P, for example, there known a structure (1) in which a light emitting portion (not shown) and a light receiving portion (not shown) are used to detect the light emitted from the light emitting portion by the light receiving portion. Then, based on the light transmission amount, the remaining amount of the developer t within the cartridge P is detected. Further, there is known a structure (2) in which bias is applied onto the development roller to detect a capacitance between a conductive sheet metal and the development roller. With this, from a value of the capacitance, the remaining amount of the developer "t" within the cartridge P is detected. Further, there is also known a structure (3) in which a developer supply roller is used in place of the sheet metal. Note that, the developer supply roller serves to apply the developer on a peripheral surface of the development roller. In the above-mentioned respective embodiments, too, although not being illustrated, the developer supply rollers are used. Therefore, in the block diagram illustrated in FIG. 18, in a case of the above-mentioned structure (1), the developer remaining amount signal 600 refers to a signal, for example, in response to a value based on the amount of light detected by the light receiving portion. Further, in the cases of the above-mentioned structures (2) and (3), the developer remaining amount signal 600 refers to a signal in response to a value of the capacitance.

As described above, an image forming apparatus 400, to which the fifth embodiment of the present invention is applied, is as follows.

Among the plurality of cartridges P, the cartridge P to be replaced is discriminated, and when the cartridge P to be replaced reaches the mounting and detaching position for the cartridge, the groove portion 19 (engaging portion, first groove portion) and the rotary member 22 (pressure member) are engaged with each other. With this, a load that is required for the movement of the tray 16 (cartridge supporting member) is made larger than a load of a case in which the groove portion 19 and the rotary member 22 are not engaged with each other. According to this embodiment, among the plurality of cartridges P, the cartridge to be replaced is discriminated. Then, the groove portion 19 and the rotary member 22, which correspond to the cartridge to be replaced, are engaged with each other. With this, when the cartridge to be replaced reaches the mounting and detaching position, a load that is required for the movement of the tray 16 is made larger than a load that is required at positions other than the mounting and detaching position.

Further, the image forming apparatus 400 includes: the movable member 31, which is movably provided to the apparatus main body 400, and includes the groove portions (second groove portions) 36; and the control portion 101, which discriminates a cartridge to be replaced upon receipt of a developer remaining amount signal 600, and moves and stops the movable member 31 in accordance with the cartridge P to be replaced.

Further, a plurality of the groove portions (first groove portions) 19 are formed along the movement direction E of the tray 16 so as to be fixed to the apparatus main body 400. Further, a plurality of the lower groove portions (second groove portions) 36 are formed in the movable member 31 that moves along the groove portion 19. Then, the control portion 101 moves the movable member 31 until a position at which the groove portion 19 that corresponds to the cartridge to be replaced P among the groove portions 19 formed in the plurality of places and the predetermined groove portion 36 among the plurality of groove portions 36 are aligned with each other in a direction orthogonal to the movement direction E. At this time, the groove portions 36 other than the predetermined groove portion 36 among the plurality of groove portions 36 are not aligned with the groove portions 19.

With this, for example, when the cartridge PY is mounted and detached, at a position at which the predetermined groove portion 19*w* among the plurality of groove portions 19 and the predetermined groove portion 36*c* among the plurality of the groove portions 36 are aligned with each other, the user obtains the clicking feeling upon drawing out the tray 16. At positions at which the other cartridges are mounted and detached, the user cannot obtain the clicking feeling. This is because, with the lower surface 31*a* of the movable member 31, the engagement of the rotary member 22 with the groove portions 19 is restricted.

The groove portion 19 includes the first surface B with which the rotary member 22 comes into contact during a process in which the rotary member 22 enters the groove portion 19, and the second surface C with which the rotary member 22 comes into contact during the rotary member 22 exits from the groove portion 19 when the tray 16 is moved from the inside position to the mounting and detaching position for the cartridge. Then, the angle θ1 that is formed by the first surface B with the movement direction E of the tray 16 is smaller than the angle θ2 that is formed by the second surface C with the movement direction E. With this, the larger clicking feeling may be generated in a case of drawing out the tray 16 from the inside of the apparatus main body 400 than in a case of pushing the tray 16 into the apparatus main body 400.

Note that, in the above-mentioned respective embodiments, as the engaging portion, the groove portion 19 will be described by way of examples, but the present invention is not limited to the groove portion. In the present invention, as the engaging portion, there may be used a friction member, a projection portion, or the like, as long as being a structure in which, through the engagement of the pressure member, a load required for the movement of the tray may be made larger than a load required for a case where the engaging portion and the pressure member are not engaged. Further, the pressure member is not limited to the rotary member 22. In the present invention, as the pressure member, for example, there may be used a spherical surface portion, and there may be used a structure as long as being capable of enlarging, through the engagement with the engaging portion, the load required for the movement of the tray than the load when the engaging portion and the pressure member are not engaged.

Note that, in the above-mentioned respective embodiments, descriptions are made of examples in which the groove 19 (engaging portion) is arranged for the every cartridge supported by the tray 16, but is not limited thereto. For example, the groove 19 (engaging portion) may be arranged at a position only, which corresponds to a position at which the cartridge P (for example, cartridge PK), which is frequently mounted and detached, is supported among the cartridges supported by the tray 16.

Further, in the above-mentioned respective embodiments, the descriptions are provided of the examples in which the grooves 19 (engaging portions) are formed in the apparatus main body 100, specifically, in the abutment member 20 provided to the apparatus main body 100, whereas, the rotary member 22 is provided to the tray 16. However the present invention is not limited to this structure. The grooves 19 (engaging portions) and the pressure member may be provided vice versa.

In other words, according to the present invention, the engaging portion (pressure member) may be provided to only one of the tray 16 and the apparatus main body abutment member 20 (apparatus main body 100), and in response to at least one of the cartridge among the plurality of cartridges P supported by the tray 16.

Further, according to the above-mentioned respective embodiments, there is exemplified a case in which the rotary member (pressure member) 22 is elastically urged, to thereby disengageably engage with the groove (engaging portion) 19. However, according to the present invention, it is not necessary for the rotary member 22 to be elastically urged to engage with the groove 19. The elastic force for engaging both is not always necessary. However, through operation of the elastic force, the both may be smoothly engaged and detached.

Further, in the above-mentioned respective embodiments, the mounting and detaching position for the cartridge refers to a position at which the mounting and detaching of the cartridge P with respect to the tray (cartridge supporting member) 16 is carried out. Then, the mounting and detaching position for the cartridge is positioned downstream in a drawing direction E of the tray (cartridge supporting member) 16 than in the case in which the respective cartridges P are positioned at the image formation positions PS. According to the above-mentioned respective embodiments of the present invention, the mounting and detaching position for the cartridge refers to a position at which the user can detach the cartridge P supported by the tray 16 from the tray 16 from the outside of the apparatus main body 100, and a position at which the user can mount the cartridge P to the tray 16 from the outside of the apparatus main body 100. Consequently, the mounting and detaching position for the cartridge is not limited to the outside of the apparatus main body 100, but may be a position, even in the inside of the apparatus main body 100, as long as the mounting and detaching of the cartridge P with respect to the tray 16 (FIG. 6A, FIG. 8, and FIG. 12A) may be made.

Further, according to the respective embodiments as described above, the groove (engaging portion) 19 may be provided in either one of the tray 16 and the apparatus main body 100 to 400, and at a position in accordance with the mounting and detaching position of at least one of the cartridge among the plurality of cartridges P supported by the tray 16.

Further, according to the above-mentioned respective embodiments, the tray 16 is linearly movable with respect to the apparatus main body in a direction orthogonal to the longitudinal direction of the cartridge. However, the tray 16 may be linearly movable with respect to the apparatus main body in a direction parallel to the longitudinal direction of the cartridge.

Further, according to the above-mentioned respective embodiments, it may be constructed such that the tray 16 may be removed from the apparatus main body by releasing the stopper (not shown).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-286388, filed Nov. 7, 2008, which is hereby incorporated by reference herein in its entirety.

What is claimed is:

1. A color electrophotographic image forming apparatus having an apparatus main body to which a plurality of cartridges are detachably mounted to form an image on a recording medium, the color electrophotographic image forming apparatus comprising:

a cartridge supporting member, which moves between an inside position that is positioned inside the apparatus main body and a mounting and detaching position at which the plurality of cartridges are mountable and detachable, while supporting the plurality of cartridges;

an engaging portion, which is provided to the apparatus main body, and to a position corresponding to the mounting and detaching position of at least one cartridge among the plurality of cartridges supported by the cartridge supporting member;

a pressure member, which is provided to the cartridge supporting member, and which is disengageably engaged with the engaging portion, wherein a cartridge to be replaced is discriminated among the plurality of cartridges, and by engaging the engaging portion with the pressure member, a load required for movement of the cartridge supporting member when the cartridge to be replaced reaches the mounting and detaching position is made larger than a load required for movement of the cartridge supporting member at positions other than the mounting and detaching position;

a movable member, which is movably provided to the apparatus main body, and comprises a groove portion as the engaging portion; and a control portion, which discriminates a cartridge to be replaced upon receipt of a developer remaining amount signal, and moves and stops the movable member in accordance with the cartridge to be replaced.

2. A color electrophotographic image forming apparatus according to claim 1, wherein the engaging portion comprises: a plurality of first groove portions, which are provided in the apparatus main body along a movement direction of the cartridge supporting member; and a second groove portion provided in the movable member that moves along the plurality of first groove portions; and wherein the control portion moves the movable member to a position at which a groove portion, among the plurality of first groove portions, in response to the cartridge to be replaced and the second groove portion are aligned with each other.

3. A color electrophotographic image forming apparatus according to claim 1, wherein the engaging portion includes a first surface with which the pressure member comes into contact during a process in which the pressure member enters into the engaging portion and a second surface with which the pressure member comes into contact during a process in which the pressure member exits from the engaging portion when the cartridge supporting member is moved from the inside position to the mounting and detaching position, and wherein an angle $\theta 1$ that is formed by the first surface with the movement direction of the cartridge supporting member is smaller than an angle $\theta 2$ that is formed by the second surface with the movement direction of the cartridge supporting member.

4. A color electrophotographic image forming apparatus having an apparatus main body to which a plurality of cartridges are detachably mounted to form an image on a recording medium, the color electrophotographic image forming apparatus comprising:

a cartridge supporting member, which moves between an inside position that is positioned inside the apparatus main body and a mounting and detaching position at which the plurality of cartridges are mountable and detachable, while supporting the plurality of cartridges;

an engaging portion, which is provided to one of the cartridge supporting member and the apparatus main body, and to a position corresponding to the mounting and detaching position of at least one cartridge among the plurality of cartridges supported by the cartridge supporting member; and a pressure member, which is provided to the other of the cartridge supporting member and the apparatus main body, and which is disengageabley engaged with the engaging portion; and, a control portion, which discriminates a cartridge to be replaced upon receipt of a developer remaining amount signal, wherein by engaging the engaging portion with the pressure member, a load required for movement of the cartridge supporting member when the cartridge to be replaced reaches the mounting and detaching position is made larger than a load required for movement of the cartridge supporting member when a cartridge other than the cartridge to be replaced reaches the mounting and detaching position.

* * * * *